US008727261B2

(12) United States Patent
Enwald et al.

(10) Patent No.: US 8,727,261 B2
(45) Date of Patent: May 20, 2014

(54) SUPPORT APPARATUS, HANDLING SYSTEM AND METHOD

(75) Inventors: Petri Enwald, Tuusula (FI); Teppo Kojo, Mäntsälä (FI); Petteri Lannes, Lappeenranta (FI); Topi Tynkkynen, Vantaa (FI)

(73) Assignee: Valmet Technologies, Inc., Espoo (FI)

( * ) Notice: Subject to any disclaimer, the term of this patent is extended or adjusted under 35 U.S.C. 154(b) by 274 days.

(21) Appl. No.: 13/266,414

(22) PCT Filed: Mar. 25, 2010

(86) PCT No.: PCT/FI2010/050237

§ 371 (c)(1),
(2), (4) Date: Oct. 26, 2011

(87) PCT Pub. No.: WO2010/125232

PCT Pub. Date: Nov. 4, 2010

(65) Prior Publication Data

US 2012/0048986 A1 Mar. 1, 2012

(30) Foreign Application Priority Data

Apr. 27, 2009 (FI) ..... 20095461
May 27, 2009 (FI) ..... 20095583

(51) Int. Cl.
*B65H 19/00* (2006.01)

(52) U.S. Cl.
USPC ..... 242/559; 242/559.4; 242/560

(58) Field of Classification Search
USPC ..... 242/559, 559.4, 560
See application file for complete search history.

(56) References Cited

U.S. PATENT DOCUMENTS

| | | | | |
|---|---|---|---|---|
| 4,183,710 | A | 1/1980 | Burdick | |
| 5,934,604 | A * | 8/1999 | Klimek | 242/559.4 |
| 6,176,670 | B1 * | 1/2001 | Salsburg | 414/391 |
| 6,264,130 | B1 | 7/2001 | Hartley, Jr. | |
| 6,685,130 | B2 * | 2/2004 | Stauber et al. | 242/533.8 |

FOREIGN PATENT DOCUMENTS

| | | | |
|---|---|---|---|
| DE | 8530500 | U1 | 12/1985 |
| DE | 20307581 | U1 | 9/2003 |
| EP | 1136406 | A2 | 9/2001 |
| GB | 2025869 | A | 1/1980 |
| WO | 01/65007 | A1 | 9/2001 |
| WO | 2010/125232 | A2 | 11/2010 |

OTHER PUBLICATIONS

International Search Report for PCT/FI2010/050237.
Written Opinion of the International Searching Authority for PCT/FI2010/050237.

* cited by examiner

*Primary Examiner* — Sang Kim
(74) *Attorney, Agent, or Firm* — Stiennon & Stiennon

(57) ABSTRACT

A movable support apparatus (10), supported on a floor and movable between at least two target stations, for receiving, moving and handing over rolls, winding shafts (1) and/or machine reels (4) intended for the handling of a fiber web. The movable support apparatus (10) has support members (12) for holding up the load being handled (1, 4) at both its support ends (2) and is adapted to be supported on a floor with at least one pressure medium cushion element (40). A handling system includes the movable support apparatus (10). Rolls, winding shafts (1) and/or machine reels (4) may be handled with the movable support apparatus (10). The movable support apparatus may be used as a movable winding stand for the winding of a fiber web (W).

5 Claims, 12 Drawing Sheets

SUPPORT APPARATUS, HANDLING SYSTEM AND METHOD

CROSS REFERENCES TO RELATED APPLICATIONS

This application is a U.S. national stage application of International App. No. PCT/FI2010/050237, Filed Mar. 25, 2010, the disclosure of which is incorporated by reference herein and claims priority on Finnish App. Nos. 20095461, filed Apr. 27, 2009, and 20095583, filed May 27, 2009.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a support apparatus, a handling system and a method. Specifically, but not exclusively, the invention relates to the handling of winding shafts, machine reels and rolls.

In paper manufacturing lines, paper manufacturing operates as a continuous process. The paper web being output from the paper machine is wound with a winder around a winding shaft, i.e. a reel spool, into a machine reel, the diameter of which may be more than 5 meters and which may weigh more than 160 tons. The purpose of the winding is to transfer the paper web from its planar manufacturing form into a form in which it can be handled more easily. At the winder, which is located in the main machine line, the continuous process of the paper machine is interrupted for the first time, after which the process continues in stages. Every attempt is made to interlink these stages as smoothly as possible so that the work already performed would not be wasted.

The web of the machine reel generated during paper manufacture is full-width and even more than 100 km long, so it must be cut into partial webs of a suitable width and length for customers and wound around cores into "customer rolls" before dispatch from the paper mill. As known, this slitting and winding of the web takes place in a separate machine fitted to the purpose, i.e., a slitter-winder.

In the slitter-winder, the machine reel is unwound, the broad web is slit with the slitting section into a number of narrower partial webs, which are wound with the winding section around winding spools, such as cores, into customer rolls. When the customer rolls are ready, the slitter-winder is stopped and the rolls, or "set", is removed from the machine. After this, the process continues with the winding of a new set. These stages are repeated periodically until the paper on the machine reel runs out, at which point the machine reel is replaced and the operation restarts with the winding of a new machine reel.

In known fast-running paper manufacturing lines, the paper machine may produce more paper than a single slitter-winder is able to process, in which case more than one slitter-winder is needed in the paper manufacturing line. In some applications, the slitter-winders are located sequentially in the direction of the machine line at a certain distance from each other.

In known layout arrangements for paper manufacturing lines, the first slitter-winder is typically arranged as an "inline" slitter-winder, which means that the slitter-winder is aligned with the paper machine and the winder, i.e., located in the main machine line. The second slitter-winder is an "offline" slitter-winder, which may be positioned side by side or aligned with the paper machine after the first slitter-winder. Both slitter-winders output customer rolls, which are normally first conveyed with roll conveyors to, e.g., a roll packaging machine for packaging and finally to storage before being sent to customers.

In a manufacturing process of a fiber web, in winding, the transfer of a machine reel forwards in the process typically takes place rolling along rails either on the basis of gravity (inclined rails) or moved by a separate transfer device. The move forward from the winder may also be carried out using a lifting device, such as a hoist. The machine reel is normally conveyed with a hoist to such a slitter-winder that is not connected to the paper machine with transfer rails and lowered to transfer rails, which are typically positioned so that the height of the machine reel's center from the floor surface is about 2.5 meters. A minimum distance of 500 mm is typically applied as a safety distance between the machine reel and the surface below the machine reel, such as the floor surface. In applications where the winder of the paper machine and the slitter-winder are connected to each other with transfer rails inline, the machine reel is transferred along the transfer rails from the winder to the slitter-winder.

In the simplest implementation, particularly in the case of small machine reels, the machine reel may also be conveyed with a hoist directly to an unwind stand.

The transfer rails for full machine reels consist of horizontal or inclined rails with stand-by stations. Along transfer rails, the machine reel is transferred from one stand-by station to another until the unwinding station is reached. With horizontal transfer rails, the machine reel is transferred from one stand-by station to another by means of a transfer device, and with inclined transfer rails, by means of rolling based on gravity and stop and release mechanisms.

An unwinding station typically consists of an unwind stand which holds the machine reel up during unwinding. The unwind stand comprises a first unwind stand on the driving side and another unwind stand on the tending side. The ends of the machine reel are on these unwind stands during unwinding. Locking arms are fastened to the unwind stand with joints; the arms are used for locking the machine reel in place during unwinding. A machine reel located in an unwinding station is connected to a brake generator, which functions as a drive of the unwinder.

Generally, a winding shaft emptied as a result of unwinding is removed from the unwinding station either through manual lifting with a hoist or automatically with a winding shaft handling apparatus. A winding shaft handling apparatus consists of either vertical lifting devices or rotatable lifting arms and return rails for empty winding shafts, located above. An empty or nearly empty winding shaft is lifted with a lifting device or with lifting arms to return rails, which normally have a number of return positions. Typically, a return station (a winding shaft storage) is located above the unwinding or the slitting and winding section. Along the return rails, the winding shaft is transferred from one station to another either by means of a transfer device or by means of rolling based on gravity, using stop and release mechanisms. The empty winding shaft is removed from the return rails and moved to the winder of the paper machine with a hoist. In an inline solution, the return rails may also be connected directly to a winder's winding shaft storage rails, whereby the winding shaft may be transferred directly from the slitter-winder to the winder.

To ensure a smooth continuity of the process, storage spaces are needed in the slitter-winder area for full machine reels, partly filled machine reels and empty winding shafts.

As known, such storage spaces at the finishing end of the fiber web manufacturing line are located in the main machine line between the main devices of the manufacturing process in the winding and slitting-winding area of the fiber web, i.e., between the slitter-winders, unwinders of slitter-winders, coating machines or calenders, and the windup belonging to the paper machine or a coating machine. The storage of the machine reels takes place on storage stands, transfer/storage rails or, in the worst case, on the floor.

If a machine reel must be moved in the lateral direction from a rail line defined by a windup to, e.g., another slitter, which may be located in an aisle of the building, a machine reel cart supported on a floor by means of rails is typically used for the lateral transfer, in which case the machine reel is loaded from the end of the transfer rails or lifted with a hoist.

The reel cart (e.g., OptiCart, ValCart brands) integrates the functions of a steel structure sufficient for supporting the heavy machine reel, in some cases, an apparatus section necessary for moving the machine reel, an energy transfer/storage arrangement necessary for producing kinetic energy, actuators necessary for receiving and handing over the machine reel and their power supply, and safety devices to secure the automated functions.

With a machine reel cart movable on rails, it is possible to move and hand over machine reels on the rails of the receiving station or to be lifted with a hoist. A cart provided with fixed rails may only operate in a certain area defined by the rails. Furthermore, the driving order of the machine reels cannot be changed with reel carts; rather, when changing the driving order, machines reels must be lifted with a hoist.

Currently, "fixed winding stands" are used in unwinders and windups, whereby machine reels and winding shafts are locked on the stand using locking jaws for the duration of winding. The machine reel or the winding shaft is brought to the stands either by rolling along rails or with a hoist. After the winding, the machine reel or winding shaft is moved away from the stand by means of a transfer device, for example. The winding station has a drive and provides a possibility to deviate the reel in the lateral direction either throughout the winding or at one time as a lateral shift before the winding is begun. The maximum range of the lateral shift is typically +−50 mm. The lateral shift is an integrated function of the winding stand.

It is possible to use automatic splicing devices and automatic splicing methods at the unwinders and windups.

The winding shaft handling solutions implemented in the prior art are inflexible. For example, it may be difficult to make paths of winding shaft and machine reel transfer carts, transfer rails, and transfer and conveyance routes of gantry cranes adjust to changing needs, such as the needs of the cycling process of machine reels in a flexible way. It is difficult to turn winding shafts and machine reels with transfer carts that are supported on rails and/or wheels. The moving and turning of winding shafts and machine reels imposes special requirements and takes room with transfer carts that are supported on rails and/or wheels. It may be difficult to change the order of the machine reels with transfer carts. The handling solutions for winding shafts require expensive concrete and steel beam structures implemented according to the full machine reel in order to hold up lifting devices, such as hoists. The hoist capacity may be reserved, in which case the hoist may not be able to respond to transfer needs at a short notice.

EP 1266091 B1 discloses a transfer cart supported on a floor, used for transferring machine reels at the height of transfer rails for machine reels.

U.S. Pat. No. 4,789,039 discloses an air cushion element for an air cushion transport apparatus.

U.S. Pat. No. 4,183,710 discloses an air cushion transport device whereby a customer roll to be moved is supported from the lower surface of the outer circumference of the customer roll.

SUMMARY OF THE INVENTION

According to a first aspect of the invention, a movable support apparatus is provided, supported on a floor and movable between at least two target stations, for receiving, transferring and handing over rolls, winding shafts and/or machine reels intended for the handling of a fiber web, the movable support apparatus comprising support members for receiving and holding up the load being handled at both its support ends. The movable support apparatus is adapted to be supported on a floor with at least one air cushion element and the movable support apparatus has a movable support chassis for holding up the load, and a transfer device separate from the support chassis. The transfer device can be connected to the support chassis to control the chassis during transfer and can be disconnected from the chassis.

According to a second aspect of the invention, a method is provided for handling rolls, winding shafts and/or machine reels intended for the handling of a fiber web by means of a movable support apparatus supported on a floor, the movable support apparatus being movable between at least two target stations and comprising support members for holding up the load being handled at both its support ends. The method comprises the steps of

- arranging the support of the movable support apparatus on a floor with at least one air cushion element;
- receiving at least one roll, winding shaft and/or machine reel on support members, which are arranged on a support chassis comprised by the movable support apparatus;
- connecting a transfer device comprised by the movable support apparatus and separate from the support chassis to the support chassis; and
- controlling the support chassis using the transfer device during the transfer.

According to a third aspect of the invention, a handling system is provided for receiving, moving and handing over rolls, winding shafts and/or machine reels intended for the handling of a fiber web by means of a movable support apparatus supported on a floor and movable between at least two target stations, the movable support apparatus comprising support members for holding up the load being handled at both its support ends. The handling system comprises a movable support apparatus adapted to be supported on the floor with at least one air cushion element and the movable support apparatus comprises:

- a movable support chassis for holding up the load;
- a transfer device separate from the support chassis; the transfer device can be connected to the support chassis to control the chassis during transfer and can be disconnected from the chassis; and the handling system comprises:
- at least two movable support chassis; and
- at least one transfer device.

Preferably, the handling system comprises at least two transfer devices. It is preferable to arrange at least two transfer devices for the sake of redundancy in the handling system in case of faults in the transfer device, for example. In such cases, a faulty transfer device or one needing maintenance may be replaced by a standby second transfer device. In cases where it is required to move a machine reel in both directions in the lateral direction of the winder (e.g., if there is a slitter-winder at both sides of the winder) is may be preferable to arrange a separate transfer device for both transfer directions. Two transfer devices enable a faster exchange of a machine reel at a windup or unwinder, as there is a separate transfer device for the chassis of both the emptying and the new machine reel and the transfers can be carried out at least partly simultaneously.

According to a fourth aspect of the invention, a fiber web manufacturing line is provided, comprising a movable support apparatus or handling system in accordance with any aspect or embodiment of the invention.

At least one air cushion element may be fastened to the support chassis, preferably at least two air cushion elements per each end of the support chassis. At least one air cushion element may be fastened to the transfer device.

Air cushion techniques are applied in the air cushion element using which the chassis section can be moved with little energy as the use of air is almost friction-free.

When the chassis and as necessary the load with it has been moved to the required end location, such as an interim storage location, the air supply can be cut, whereby the chassis can be lowered on the bearing structure of the chassis against the floor.

The transfer device can be disconnected from the chassis after the transfer. After disconnection, the transfer device can be moved to the next operating site without the chassis section. The transfer device can remain in place after the transfer, for example, to wait for the next transfer of the same chassis or to wait for the transfer of another chassis.

Preferably, the transfer device and the support chassis are separated into different devices. The devices can be connected to and disconnected from each other. This enables implementing an advantageous, dynamically modifiable storage solution for rolls, winding shafts and/or machine reels. Several chassis and a fewer number of transfer devices than the number of chassis may be used for the handling of rolls, winding shafts and/or machine reels. The transfer device may be connected to the short and/or the long side of the chassis.

The section of the movable support apparatus comprising the more complicated apparatus section may be arranged in the transfer device. The transfer device may be manually driven and/or automatic. The transfer device may be switched to a manual drive mode or an automatic drive mode. The transfer device may have a position for the user. An apparatus section necessary for the transfer of the chassis may be arranged in the transfer device, such as a drive and wheels, en energy transfer arrangement necessary for producing kinetic energy and/or an energy storage arrangement, such as compressed-air hoses, cables, etc. or batteries, an energy supply for the actuators necessary for receiving and handing over the machine reel; and safety devices for securing the automatic functions such as sliding protective guards.

The load supporting function may be arranged in another, simpler chassis section in the movable support apparatus. The chassis section may be formed of steel, for example, or some other known load-carrying material. The chassis section may be arranged with actuators necessary for receiving and handling over the machine reel, such as rail gates, transfer members, etc., and safety devices necessary for securing the automatic functions, such as a shock reducer.

Rolls, winding shafts and/or machine reels may be stored on the chassis. A winding stand for winding shafts and/or machine reels may be implemented using the chassis. A windup stand for winding shafts and/or machine reels may be implemented using the chassis. An unwind stand of a slitter-winder and/or of a reject station may be implemented using the chassis. The same chassis may function as a windup stand and unwind stand for the machine reel.

It is possible to arrange for the traffic of winding shafts and machine reels in the manufacturing line of the fiber web between a winder and a slitter-winder by means of the chassis movable using the transfer device. Full machine reels can be moved from a windup to an unwinder to be unwound in the desired order. After windup, machine reels may be stored in the desired order not only in the area between a winder and a slitter-winder but also elsewhere in the machine hall or within the traffic area of the movable support apparatus.

It is possible to implement a deviation in the lateral direction of the fiber web reel to be wound, i.e., its lateral shift, by means of the chassis. The lateral shift may be one-off or continuous. The compensation of the growth/diminishing of the fiber web reel being wound at the winding station may be implemented by means of the chassis. Preferably, the actuator (s) of the lateral shift are at floor level or below it and, preferably, the actuators of the lateral shift are fixedly installed and not in the moving chassis structure.

The air cushion elements may be fitted to the movable support apparatus at such a distance from each other that a winding shaft or machine reel may be transferred with the movable support apparatus over a pulper opening so that the air cushion elements move outside the borders of the pulper opening during transfer. The movable support apparatus may be moved over the pulper opening in the machine direction. The movable support apparatus may be moved over the pulper opening in the transverse direction. In accordance with some embodiments, a movable support apparatus may be moved over the pulper opening in the machine direction and in the transverse direction.

In this description, "floor" refers to such an even support plane on which the movable support apparatus may be moved by means of air cushion technology, such as a machine hall floor, the floors and support planes in the aisles of the building, and the surface of the ground outside the building. The movable support apparatus may be moved over minor unevenness on the support plane.

In some cases, it is possible to move rolls, winding shafts and/or machine reels between buildings outside using the movable support apparatus. In some cases, it is possible to store rolls, winding shafts and/or machine reels on chassis outside on the ground/on ground level by means of the movable support apparatus.

When a transfer arrangement implemented using a chassis and transfer device separated from each other is applied, the handling of rolls, winding shafts and/or machine reels can be implemented in a cost-efficient manner. This enables providing a transfer arrangement that can be used to replace or supplement other transfer arrangements in a flexible manner. Other transfer arrangements include a hoist, and a transfer cart for winding shafts and machine reels moving on rails, used as a transfer device, on which and from which the load is moved with a hoist and using fixed storage stands as storage locations, and a transfer cart for winding shafts and machine reels, moving on rails and enabling the loading of a load on transfer rails by means of movable transfer carriages.

The target station of the movable support apparatus, particularly the chassis, may be a device of the fiber web manufacturing process arranged for a roll, a winding shaft and/or a machine reel, e.g., a windup station or an unwinding station; a storage position; a storage rail; a transfer rail; a reject location; a location related to roll maintenance, such as a roll grindery; or another support chassis. The target stations may be within the area of one or more machine halls and/or within the area of one or more fiber web manufacturing processes and/or within the area of one or more fiber web manufacturing lines.

The movable support apparatus may be used to move loads below a hoist. The movable support apparatus may be used to arrange the handling of winding shafts without a hoist.

The movable support apparatus may be used to move loads in the horizontal direction. The movable support apparatus may be used to turn loads in place. The movable support apparatus may be used to move loads in the direction of the main manufacturing line. The movable support apparatus may be used to move loads in the transverse direction of the main manufacturing line. The movable support apparatus may be used to move loads substantially in all directions of the XY coordinate system in a machine hall. The X direction refers to the direction of the machine line defined by the fiber web manufacturing devices or the finishing devices; the Y direction refers to the horizontal direction transverse to the X direction.

In addition to handling winding shafts, the movable support apparatus may be used to provide for the handling of other loads, such as lifts/transfers and storage in connection with maintenance shutdowns, for example.

Preferably, a manufacturing line comprises a first slitter-winder located after a windup. Preferably, the manufacturing line additionally comprises a second slitter-winder located after/to the side of the first slitter-winder. Preferably, the manufacturing line is located in a machine hall.

Preferably, the movable support apparatus with its load is movable between a windup and a first slitter-winder. Preferably, the movable support apparatus with its load is movable between a windup and a first slitter-winder. Preferably, the movable support apparatus with its load is movable in the direction of the machine line. Preferably, the movable support apparatus with its load is movable between a winder and the next process apparatus following the winder in the process order.

Preferably, the movable support apparatus comprises at least one driving wheel supported on a floor for moving the movable support apparatus on a support surface. The driving wheel is preferably rotatable. The transfer device may comprise at least one driving wheel. At least one steering wheel may be arranged in the support chassis. The steering wheel may be rotatable. The steering wheel enables steering the moving direction of the chassis when the chassis is positioned or turned, for example. Preferably, the movable support apparatus comprises at least one electrical or pressurized air drive for the driving wheels.

The chassis section of the movable support apparatus comprises reception members for the loads to be stored for receiving and holding up the load at both its support ends, such as shaft necks. The reception members may comprise a storage space for one or more rolls, winding shafts and/or machine reels. The reception member may comprise a storage rail. The reception member may comprise a load stopping point for the shaft end. The reception member may comprise a locking device for locking the load in place. The movable support apparatus, particularly the chassis section, may comprise a steel beam structure. The reception member may comprise a rail fastened with joints in a rotating manner or a rail sliding in the axial direction, such as a section of a rolling rail, for moving the load. A rail, e.g., a section of a rolling rail, can be turned up or to the side with an actuator. The reception member may comprise a transfer member for moving the load and/or the moving of the load in connection with the reception member may be based on gravity and take place by rolling. The transfer member for moving the load may be arranged to operate in connection with a rail fastened with joints or operating by sliding.

The reception member may be rigidly fastened to a certain level in the chassis section. The reception member may be movable in the vertical direction.

The movable support apparatus may be electrically driven. The movable support apparatus may comprise at least one battery for electrical drives. Power supply for the movable support apparatus may be arranged with a cable, preferably through an unwinding and rewinding cable reel. The power supply through a cable may be implemented through the ceiling or otherwise away from floor level, e.g., on posts, e.g., after a winder. In some conditions, the movable support apparatus may also be gas-driven, e.g., in very well ventilated conditions. In accordance with some embodiments, the electrical power supply of the movable support apparatus is implemented wirelessly, e.g. inductively, whereby it may not be necessary to resort to power stored in a battery. The path of the movable support apparatus may be automated, for example, by means of identifiers located on a floor. Preferably, the movable support apparatus comprises a safety device, such as a shock reducer, and/or an optical signaling device, such as a flasher, and/or a stopping sensor and/or an acoustic signaling device, such as a buzzer.

The pressure supply of the air cushion element(s) may be arranged through the transfer device and/or the pressure supply may be arranged through the support chassis. The pressure supply may be arranged through a distribution system of pressurized air or pressurized gas arranged in the floor. Air or another pressurized gas may be used as the pressurized gas. The distribution system of pressurized air may comprise air supply points. The air supply points may be embedded in a floor at a certain spacing depending on the size of the support chassis. The pressurized air supplies may be controlled on and off depending on the position of the chassis during transfer. The movable support apparatus may comprise an inlet of pressurized air, which can be connected to a pressurized air supply outside the support apparatus. The external pressurized air supply may be implemented through the ceiling or arranged in another way off the floor level. The pressure supply may be arranged on posts, e.g., after a winder. The pressure supply may be arranged away from the floor level on a carriage supported by guides. Preferably, the pressurized air supply is implemented using a pressure hose. The pressurized air source may comprise a hose reel. The pressurized air supply may be implemented without an external pressure source. The pressurized air supply may be implemented using a compressor located in the transfer device.

In accordance with some embodiments, a chassis section comprises a steel structure without air cushion elements and a transfer device moving the chassis comprises air cushion elements. Thereby, a transfer device may be driven under the chassis section bearing the load, whereby the chassis with its load is lifted off the support surface and moved. This application enables implementing a very advantageous storage solution for machine reels and/or winding shafts by means of several chassis sections. Using several chassis sections enables implementing a simple solution containing few components.

Changing of the level of the chassis may be used to help move the load into and away from the chassis. Changing of the level of the chassis may be used to implement loading without loading actuators. The mass of the load may be determined by measuring the level of the chassis, the change in the level, the supplied volume of air and/or the pressure of air in the air cushion elements.

It is possible to decrease the fixed storage spaces in the manufacturing line, particularly between a windup and a slitter-winder. At least some of the fixed storage spaces decreased between the windup and the slitter-winder may be located in the at least one movable support apparatus for machine reels and/or winding shafts comprised by the manufacturing line. Decreasing storage spaces is advantageous particularly in the case of target stations where a lifting device such as a hoist has limited access to a load below a storage location. A movable support apparatus enables implementing the winding shaft traffic between a winder and a slitter-winder in part or in its entirety.

Some aspects and/or embodiments of the invention enable achieving a very considerable financial advantage in the form of reduced construction costs, as the fiber web manufacturing line can be accommodated in a smaller, particularly lower, building of a lighter structure. A smaller building volume may be sufficient for a manufacturing line. The building may also be noticeably shorter, as it is not necessary to store machine reels consecutively in the direction of the machine line; rather, free space may be more flexibly used for storage and empty storage locations/the storage of empty shafts do not require fixed positions in the machine line, cf. a rail system or fixed stands.

Arrangements in accordance with some aspects and/or embodiments enable layout solutions for the manufacturing line of a paper machine that enable an entirely new approach to the storage and handling of either winding shafts or machine reels or both in connection with winding and/or slitting.

Loads such as winding shafts can be transported flexibly and comprehensively over large areas and using comprehensive alternative routes, for example. It is possible to automate and standardize the load transfer functions, whereby the operations can be arranged efficiently and safely.

Another safety-enhancing feature is the possibility to decrease lifting and transfer operations implemented using lifting ropes. It is possible to avoid the number of lifts and transfers implemented using long lifting ropes, whereby it is also possible to avoid collisions of loads due to lifting device control errors.

According to an aspect of the invention, a movable support apparatus is provided for receiving, transferring and handing over rolls, winding shafts and/or machine reels intended for the handling of a fiber web, supported on a floor and movable between at least two target stations, the movable support apparatus comprising support members for holding up the load being handled at both its support ends and being adapted to be supported on the floor by means of at least one pressure medium cushion element whose pressure medium comprises liquid, preferably water.

Machine reels and winding shafts refer to winding shafts at different stages of the fiber web manufacturing process with varying amounts of paper around them, i.e., full machine reels, partially filled machine reels, reject reels and winding shafts. Rolls refer to rolls and cylinders used for processing the fiber web in the devices of the fiber web manufacturing process.

In this description and the claims, the term "reel spool" is used to refer to winding shafts or similar, around which the machine reel is wound and from which the machine reel is unwound before slitting. Even if this description primarily refers to paper, the invention can also be applied in connection with the manufacture of other fiber webs.

Various embodiments of the present invention will only be or have only been described in connection with one or some of the aspects of the invention. A person skilled in the art will appreciate that any embodiment of an aspect of the invention may be applied in the same aspect and other aspects alone or in combination with other embodiments.

BRIEF DESCRIPTION OF THE DRAWINGS

The invention will be described in the following by way of example with reference to the appended schematic drawings.

DESCRIPTION OF THE PREFERRED EMBODIMENTS

In the following description, like references refer to similar parts. It should be noted that the figures are not to scale and mainly serve the purpose of illustrating embodiments of the invention.

Figure 1:
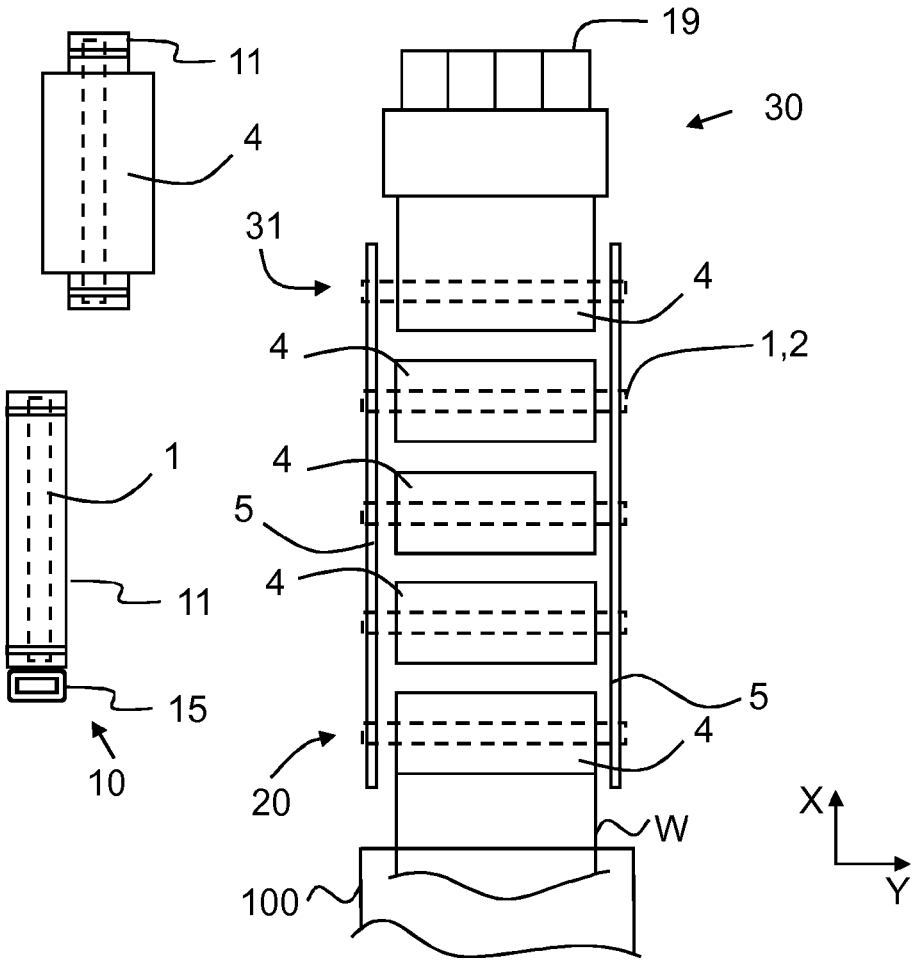
FIG. 1 shows the dry end of a paper manufacturing line, where a machine reel is moved from a winder to a slitter-winder on transfer rails.

A fiber web manufacturing line shown in FIG. 1 comprises a fiber web machine such as a paper machine 100 and a windup 20 in line with it and a slitter-winder 30. A paper web W being output from the paper machine 100 is wound at the windup 20 by means of a winding cylinder into a machine reel 4 around a winding shaft 1.

The manufacturing line shown in FIG. 1 comprises the windup 20, an unwinder 31 and the slitter-winder 30 as the main devices of the process. The slitter-winder 30 outputs customer rolls 19, which can be conveyed with, e.g., slat-type conveyors outside the actual machine hall in the building.

Depending on the paper manufacturing process, e.g. the paper grade manufactured, flexibility may be needed in terms of storage space on a case-by-case basis for full machine reels, partially filled machine reels, reject reels, winding shafts. It is possible to create flexibility in terms of storage space by means of movable support apparatuses 10 supported on a floor and based on air cushion technology. The movable support apparatus 10 comprises a support chassis 11 for holding up a load and a separate transfer device 15 for moving the chassis 11.

It is possible to arrange storage and transfer capacity for machine reels 4 and winding shafts 1 by applying the preferred embodiments of the air cushion transfer device 10 presented in the following and by modifying said preferred embodiments to a suitable extent. Storage capacity for machine reels 4 and winding shafts 1 can be arranged, e.g., so that by simultaneously using dense positioning of main devices and locating the necessary machine reel and/or winding shaft storages away from between the main devices a short manufacturing line can be provided, enabling the use of a short machine hall. By applying embodiments of the air cushion transfer devices 10, it is in some cases possible to do without a full-scale hoist, even without any hoist, whereby the machine hall and the building may be constructed to be lower than usual.

In FIG. 1, winding stands of the machine reel 4 and the winding shaft 1 are fixed and connected together through transfer rails. The machine reel 4 traffic between the winder 20 and the unwinder 31 is arranged using transfer rails 5 comprised by the winder. Ends 2 of the winding shafts 1 are adapted to roll along the rails 5. In the application shown in FIG. 1, the movable support apparatus 10 enables moving winding shafts 10, machine reels 4 and rolls and implementing their storage in an aisle or corridor of the building, for example. The movable support apparatus 10 may be used to arrange the turning of loads in place.

In connection with transfer rails 5, the windup 20 preferably comprises a stand-by station for machine reels 4 preferably accommodating one machine reel 4 or, for example, when the flexibility or operational reliability of the process so requires, more than one machine reel 4.

It is recommended that a number of machine reels 4 and/or winding shafts 1, within the tolerance of the manufacturing process, are located in storage to be away from the immediate vicinity of the main devices of the manufacturing line, especially from between the main devices, in order to provide a layout solution that takes as little room as possible in the longitudinal direction of the building.

As the winding stands of the machine reel 4 and the winding shaft 1 in FIG. 1 are fixed and connected to each other through transfer rails 5, a separate transfer event is needed for the handing over of a machine reel 4 or winding shaft 1 (reel spool, core shaft, core) using a hoist or rails 5 on the basis of, e.g., gravity. In the implementation of FIG. 1 it is not possible to bring a machine reel or a winding shaft to the winding location with such a transfer device supported on the floor as a reel cart, etc. from the lateral direction. These are significant limitations and cost increasing factors, especially as the logistics of the dry end is aimed to be implemented cost-efficiently, e.g., without hoist operations in a light-structured hall.

It should be emphasized that the descriptions in connection with FIGS. 1 to 10 only concern example structures for implementing a movable support apparatus and that the movable support apparatus may also be implemented otherwise with regard to structures, numbers of storage spaces, types of storage spaces, positions within the storage space structures, etc.

In the following examples illustrating the handling systems of winding shafts, machine reels and/or rolls, a machine reel 4 or a winding shaft 1 is transferred or lowered to a support chassis 11 to be moved further in the process.

Figure 2:
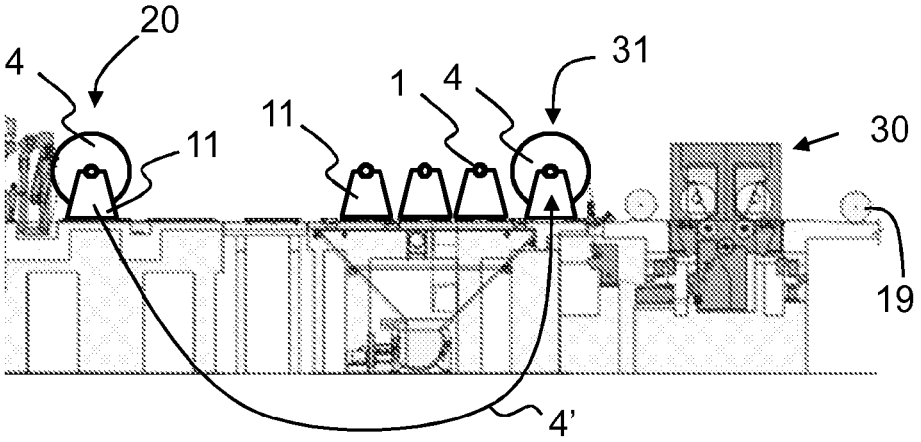
FIG. 2 shows a first paper manufacturing line where the traffic of winding shafts and machine reels between a winder and a slitter-winder is implemented using support chassis and a transfer cart.

FIG. 2 shows a solution of machine reels 4 and winding shafts 1 between a windup 20 and a slitter-winder 30, implemented with chassis 11 in accordance with some embodiments In accordance with some embodiments, a moving winding stand is formed with a chassis. Machine reels 4 are transferred to an unwinding station 31 of a slitter-winder with chassis 11 and winding shafts 1 are returned with chassis 11 to a windup 20 of a calender or another necessary windup station. A machine reel 4 can be moved with a chassis 11 from the windup station 20 in the lateral direction, for example, in the way shown by arrow 4'. A winding shaft 1 can be moved with a chassis 11, e.g., in the direction of the machine line from the unwinding station 31 to the windup station 20.

Figure 3:
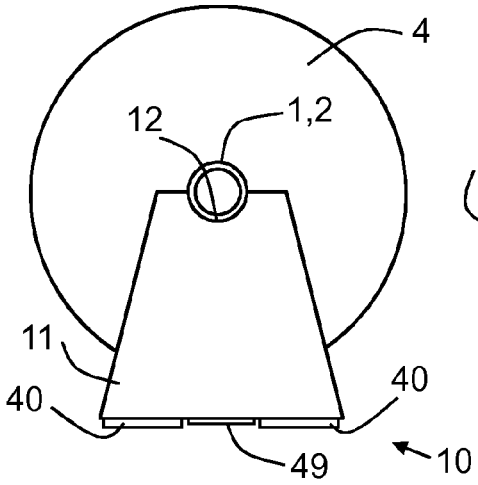
FIG. 3 shows an end view of a movable support chassis.
Figure 4:
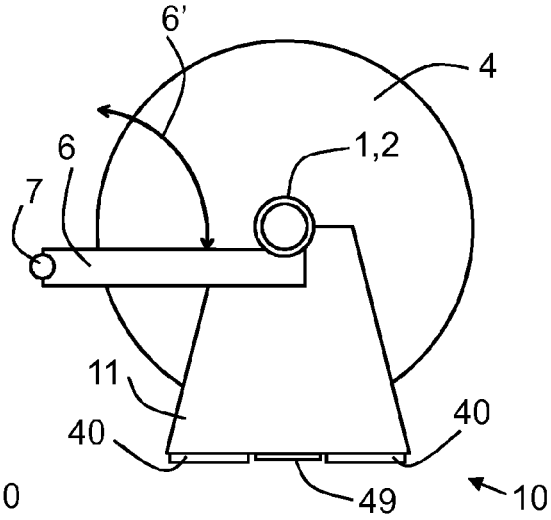
FIG. 4 shows a rail gate for moving a machine reel on a support chassis.
Figure 5:
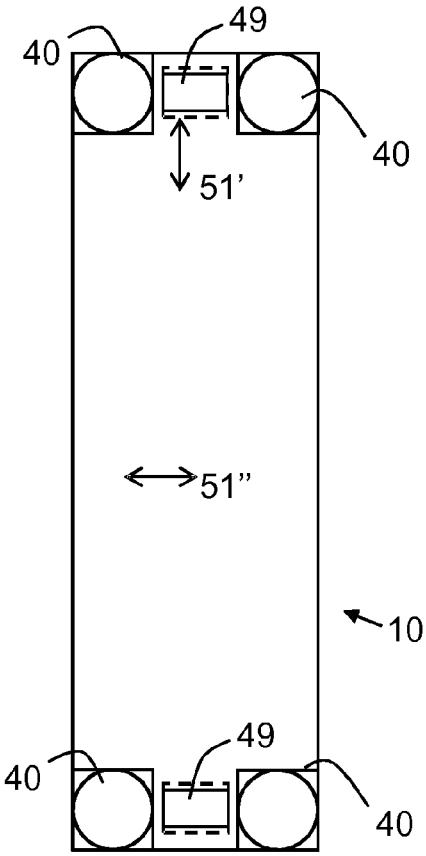
FIG. 5 shows the support chassis of FIG. 3 from below.

FIGS. 3, 4 and 5 show examples of a support apparatus 10 and a movable winding stand. In FIG. 3, the machine reel 4 can be lifted to the support apparatus 10 with a hoist or a comparable manipulator. The structure of the support chassis 11 of the movable support apparatus 10 is preferably based on a steel profile that well supports the mass to be stored in the vertical direction. The movable support apparatus 10 may be designed to receive heavy full machine reels 4, lighter partially filled machine reels 4 and winding shafts 1, or the structure of the movable support apparatus 10 may support a combination of the loads mentioned above. The chassis 11 may comprise winding shaft locking for keeping the winding shaft rotatably in place for winding. As a locating position, the chassis 11 may comprise a slot 12 for machine reels 4 and/or reel spools 1 as in "cold storage stands" when the transfers take place by lifting with, e.g., a hoist. FIG. 5 shows the support chassis 11/winding stand of FIG. 3 from below. Air cushion elements 40 and a mating surface 49 for an oscillation movement 51', which may be implemented in a winder 20, 31, are fastened below the support chassis 11 at both its ends. There are two air cushion elements 40 at both of the load carrying ends of the support chassis 11, and the mating surface 49 is arranged between the air cushion elements 40. The movement range of the oscillation movement 51' is indicated by a dashed line. The movement range is preferably +/−50 mm. Typically, the movement range of the oscillating movement 51' is +/−25 mm or less.

Another number of air cushion elements 40 than two may be arranged at each load-carrying end of the chassis 11, for example, two pairs of air cushion elements 40 at both ends to increase the operational reliability of the winding stand 10 and/or to enhance the moving ability of the winding stand 10 when moving along an uneven surface, for example. In this case, it is possible to cross rails of a reel cart line and/or grooves and/or other openings or protrusions in the floor with the winding stand 10 as necessary.

The chassis 11 may comprise a separate locking solution, e.g., a locking solution for an end 2 of a winding shaft if the machine reel 4 or winding shaft 1 is moved to the chassis with a transfer member of machine reels 4 through a rail gate 6, for example. In FIG. 4, a machine reel 4 is brought on a chassis 11 by means of a rail gate 6 and a transfer member, in which case a machine reel 4 locking mechanism is additionally needed. The movement of the rail gate 6 connected to a transfer rail 5 with a joint 7 is shown by an arrow 6'.

Naturally, the handing over and reception means for the load may be in the chassis 11 and/or mounted with joints to the frame of the handling machine, e.g., in the manner shown in FIG. 4.

In accordance with some embodiments, the chassis 11 (the winding stand) may be moved with a transfer device 15 to oscillation elements 50 located on a floor at an unwinding station 31 or a windup station 20 if oscillation and/or a lateral shift and/or centering is needed, and lowered on the oscillation elements. At the unwinding station 31 and the windup station 20, the chassis may be driven and positioned so that locking mechanisms and oscillation mechanisms 50 can be located on the floor between air cushion elements 40 and the chassis 11 can be driven to these stations from the side or from the direction of the machine line. Preferably, there is mechanical control and locking between the oscillation mechanisms 50 and the chassis 11, e.g., utilizing taper pins.

Naturally, the oscillation mechanism 50 may also be integrated in the chassis 11, whereby the oscillation mechanism may be locked on a mating surface located on a floor 8 or a transfer device fitted to the floor, moving in the direction of the machine line 51". A transfer device moving in the direction of the machine line 51" enables compensating the growth of the machine reel 4 in a winding stand 20 and implementing the transfer movement of the machine reel during its exchange sequence.

When the chassis 11 is locked to the oscillation elements 50, the coupling of the winding shaft 1 drive is closed and the web threading may begin. The drive of the winding shaft 1 may be located on a fixed base as currently and the coupling may be closed with a movement of the coupling or with a movement of the chassis 11. The lateral shift/oscillating movement 51' may be performed using, e.g., linear guides and an electromechanical or hydraulic actuator. When the machine reel 4 is unwound or wound, the chassis 11 may be moved away from the winding station 20, 31, either returning back to the side or to the next empty position in the machine direction. This introduces considerable flexibility to the implementation of the logistics and significantly reduces the number of load handling devices, etc. needed, and thus reduces costs. The air cushion elements 40 which function as the support elements of the chassis 11 are preferably adapted to be located in a direction transverse to the machine line, i.e., in the CD direction outside a potential pulper cover, whereby a transfer movement in the machine direction is possible.

Figure 6:
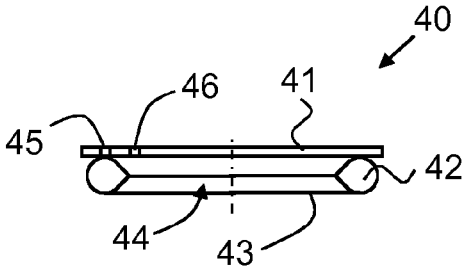
FIG. 6 shows an air cushion element.

FIG. 6 shows an example of an air cushion element. The air cushion element 40 comprises a frame 41, which is preferably plate-like, annular bellows 42 air-tightly fitted below the frame 41, and a film 43 with small holes, the film 43 being fastened to the lower edge of the bellows 42 so that the frame 41, the bellows 42 and the film 43 define a space 44 between each other for air flowing out. The air cushion element 40 comprises a first opening 45 for feeding pressurized air into the bellows and another opening 46 for feeding pressurized air into the space 44.

Figure 7:
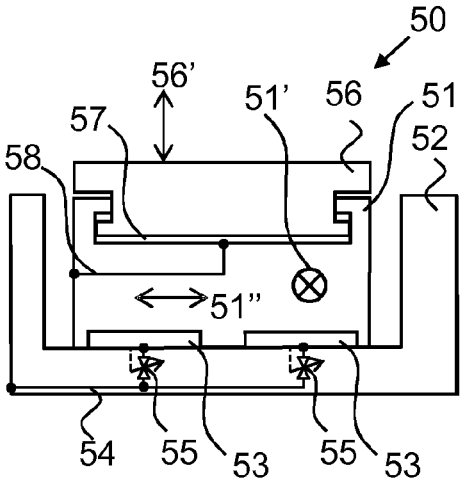
FIG. 7 shows an oscillation device for deviating a support chassis.

FIG. 7 shows an oscillation element 50 for deviating a support chassis 11 sideward in a deviation direction 51'. The oscillation element 50 shown in a cross-section comprises a frame 52, on which a carriage 51 is fitted to be moved in the oscillation direction 51'. The frame 52 is suitable to be fastened to a floor or a comparable machine plane. The oscillation element 50 may comprise several carriages 51 or carts functioning as hydrostatic glide shoes. There are oil pockets 53 for a pressure medium such as oil between the carriage 51 and the frame 52, functioning as pressure pockets, the oil pockets preferably being formed in the carriage 51. The oil is preferably conveyed to the oil pockets 53 through oil ducts 54 fitted into the frame 52. A throttle 55 for pressure balancing is preferably arranged for each oil pocket 53 in the oil duct 54. The volume flow to an individual oil pocket 53 can thus be adjusted by the throttles 55, which adjust according to load. An oil film has good dynamic properties. Friction is practically zero and the oil pocket 53 functions as a vibration attenuator. When oil is brought to the different oil pockets 53, the rigidity of the carriage becomes good. The rigidity of the system grows large when, during winding, the carriages 51 of the oscillation elements at each end of the winding shaft 1 are mechanically connected to each other. Collection of the oil leaking from between the carriage 51 and the frame 52 is arranged in the frame 52. The collection of oil may also be arranged internally in the carriage 52.

Preferably, a liftable part 56 is fitted to the oscillation element 50, the liftable part 56 being adapted to be connected and preferably locked to the mating surface 49 of the support chassis 11. The liftable part 56 preferably forms a piston fitted at its upper part to a carriage 51 formed into a cylinder. Pressure is conveyed to the volume 57 between the liftable part 56 and the carriage 51 by means of a pressure medium, such as oil, through a pressure duct 58 preferably arranged in the carriage 57.

In accordance with some embodiments, the oscillation element does not have a liftable part. The engagement between the oscillation element and the mating surface 49 can also be implemented using a mating surface 49 that can be moved downwards. Thereby, e.g., the upper surface of the carriage 51 can be engaged against the mating surface 49. The mating surface 49 can be lowered on top of the oscillation mechanism 50, e.g., through a downward movement of a winding stand 10, e.g., by lowering the winding stand 10 downward by means of air cushion elements 40. In connection with or after the downward movement, the chassis 11 may be locked to the oscillation element 50, e.g., by means of cone locking, screw locking or a jack, such as a screw jack.

In accordance with some embodiments, the oscillation element 50 may be used to compensate the growth of a machine reel 4 during winding. The carriage 51 and/or the liftable part 56, which the support chassis 11 can be aligned with and locked to by means of the mating surface 49, may also be adapted to be movable in the longitudinal direction of the machine line 51". In accordance with some embodiments, oscillation elements 50 can be used to move machine reels 4 and/or winding shafts 1 on a support chassis 11 between a winder 20 and an inline slitter 30 in the longitudinal direction of the machine line 51".

Standard components can be used in the pressure and lubricant circuits of the oscillation element 50.

Figure 17:
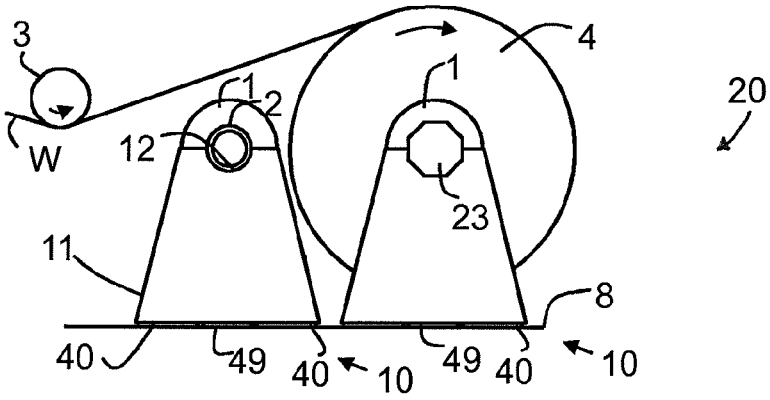
FIGS. 17 and 18 show a side view of a second machine reel exchange sequence at a windup.
Figure 18:
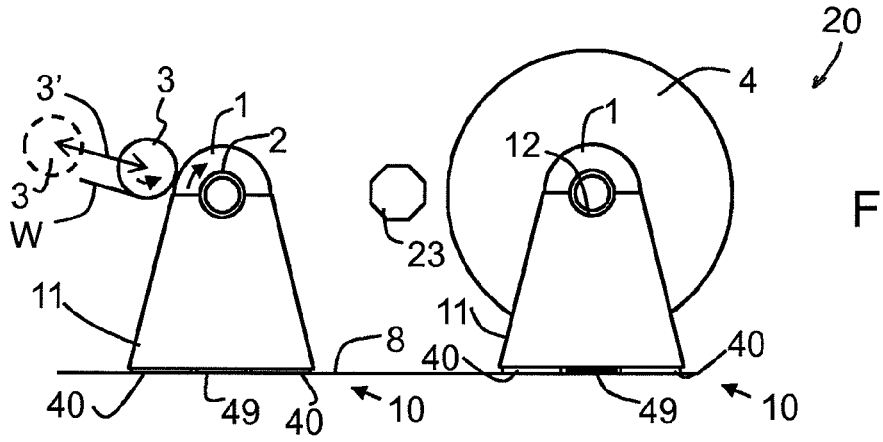

The winding stand 10 may be locked at both its ends on the tending and driving sides to oscillation elements 40, which are fitted to movement mechanisms that are movable in the longitudinal direction of the machine line 51". Thereby, it is possible to compensate the growth and diminishing of the machine reel 4 during winding. In this way, it is possible to make room for another winding stand 10 being moved to the winding station. In a windup case, a) the other winding stand 10 to be moved at the final stage of the winding may be empty when moved, an empty winding shaft 1 being lifted to it by means of a lifting device or hoist (FIGS. 13 to 16); b) the other winding stand may already hold up an empty winding shaft 1 when moved (FIGS. 17 and 18). In an unwinding case, the other winding stand 10 preferably holds up a machine reel 4 when moved (e.g. figure sequences 20, 21 and 23, 24).

Figure 8:
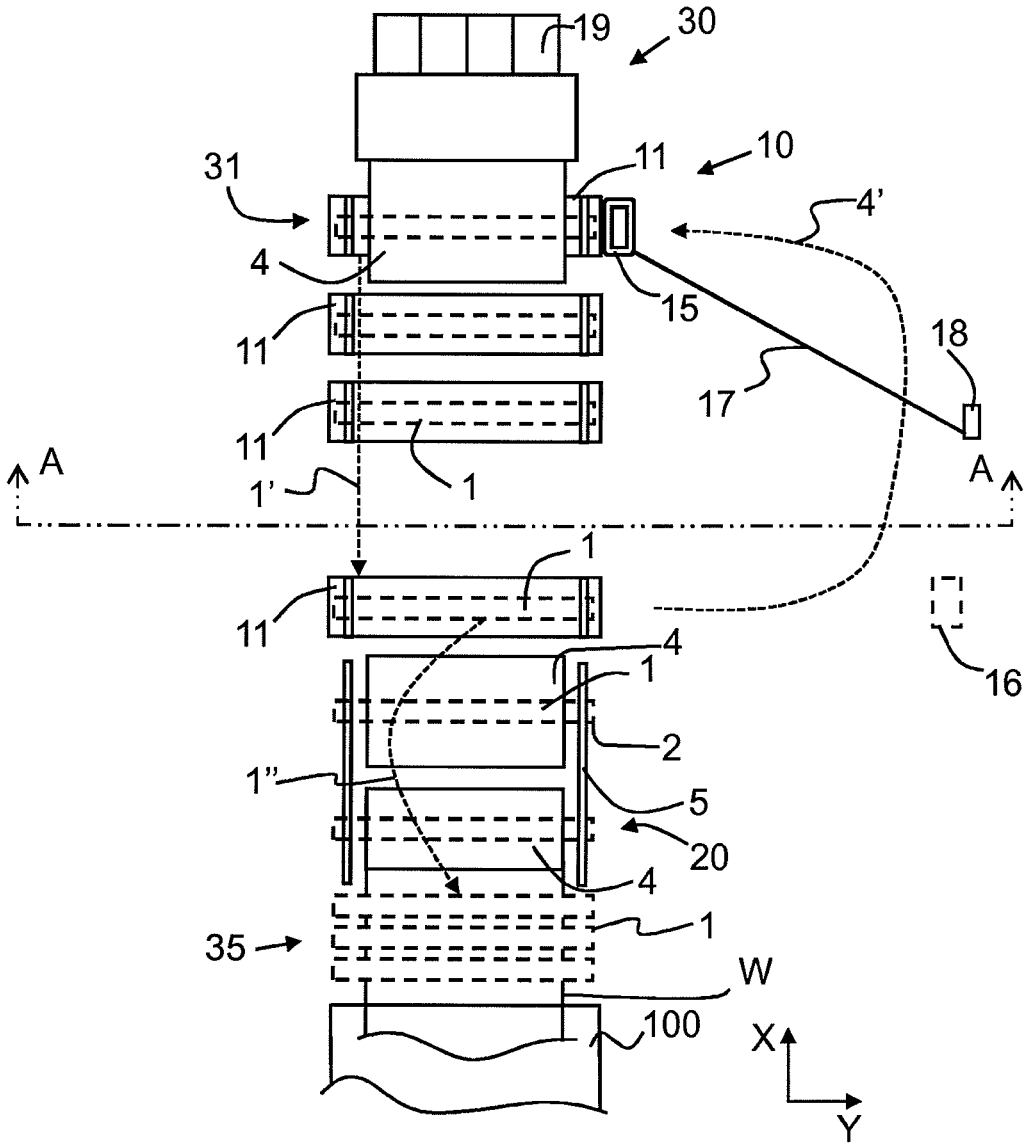
FIG. 8 shows a second paper manufacturing line where the traffic between a winder and a slitter-winder is implemented using support chassis and a transfer cart.

FIG. 8 shows a second paper manufacturing line where the cycling of winding shafts 1 and machine reels 4 between a winder 20 and a slitter-winder 30 is implemented by means of support chassis 11 and a transfer cart 15. A transfer device 15 is connected to the chassis 11 so that the chassis 11 can be steered under the control of the transfer device 15 during the transfer. In the example shown in FIG. 8, the chassis moved by the transfer device 15 is used to move a machine reel 4 to an unwinding station 31 (arrow 4'), as an unwind stand at the unwinding station 31, and as a transfer chassis of empty winding shafts, moved with the transfer device 15 to a winder 20 (arrow 1').

In FIG. 8, machine reels 4 are moved from the windup 20 through transfer rails 5 to chassis 11. When loading the machine reels 4 to the chassis 11, it is possible to use the rail gates 6 shown in FIG. 4. The winding shafts 1 are returned by means of the chassis 11, e.g., to a windup 20 of a calender. The winding shafts 1 may be lifted with a hoist to an interim storage 35 above the winder 20 (arrow 1"). A machine reel 4 can be moved with a chassis 11 from the windup station 20 in the lateral direction, e.g., in the way shown by arrow 4'. A winding shaft 1 can be moved with a chassis 11, e.g., in the direction of the machine line from the unwinding station 31 to the windup station 20.

In FIG. 8, the area above the line A-A shows the area of the machine hall at the dry end of the manufacturing line that is not in the operating area of a hoist. The height of the machine hall below the line A-A enables the operation of the hoist and the lifting of loads with the hoist. When the transfer of machine reels 4 and reel spools 1 takes place with chassis 11, a hoist is not needed and the hall may be a lower "lightweight hall" in the area above the line A-A. A home station 16 of the transfer device 15 may be close to the wall of the tending side or, e.g., at the side of the winder 20.

In FIG. 8, the pressure supply of air cushion elements 40 of the support chassis 11 is arranged through the transfer device 15. Pressurized air is used as the pressurized gas, the supply of which may be controlled on and off depending on the position of the chassis during transfer. The movable support apparatus 10 comprises an inlet for pressurized air, which can be connected to a pressurized air supply outside the support apparatus and is implemented through a pressure hose 17 running at floor level, preferably by means of a hose reel 18.

Figure 9:
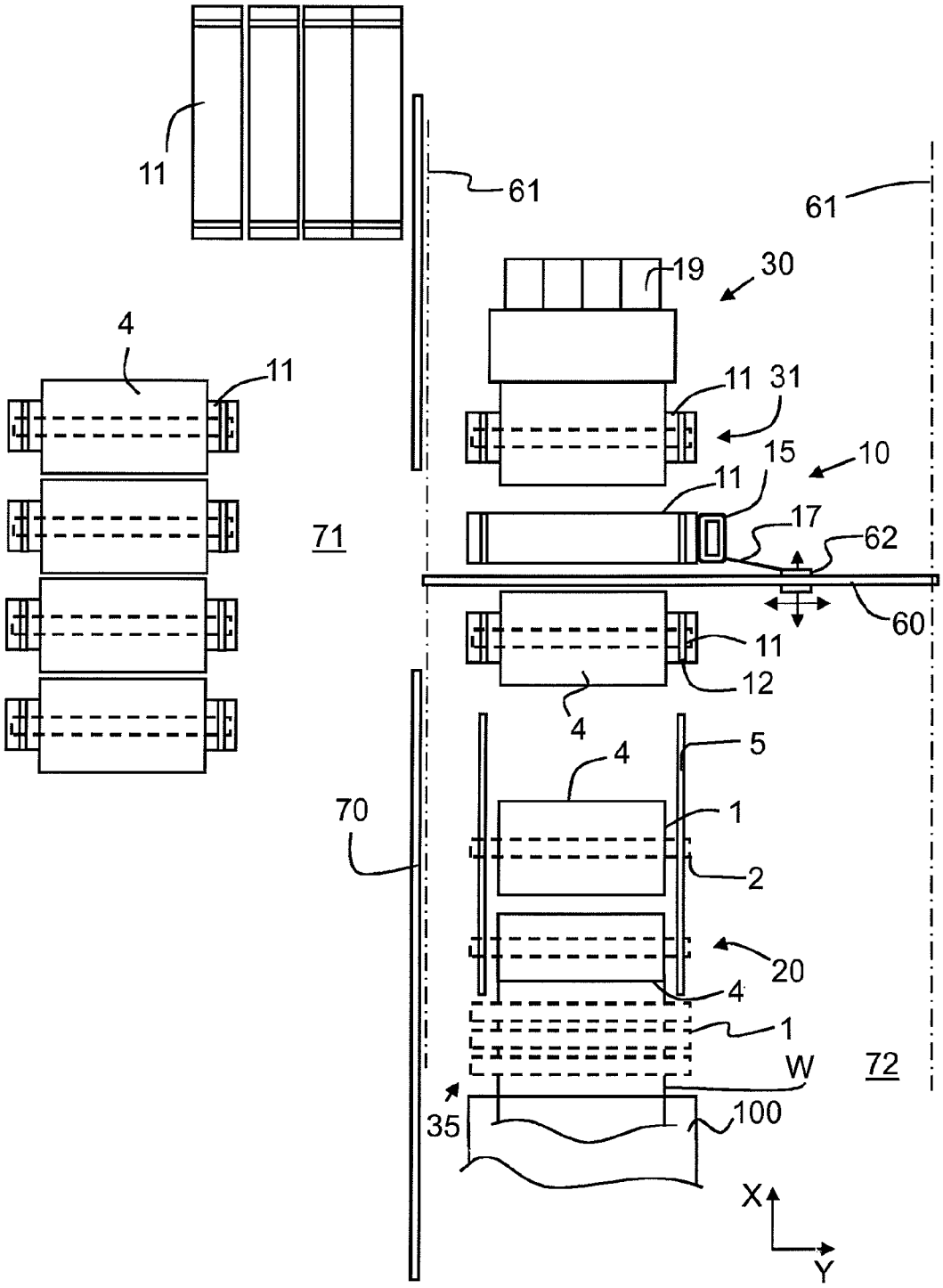
FIG. 9 shows a third paper manufacturing line.

In the paper manufacturing line in FIG. 9, chassis sections 11 are used as independent machine reel 4 and/or winding shaft 1 storage stands, which enables dynamic operation of the storage; e.g., a machine reel can be moved forward in the process regardless of the manufacturing order.

FIG. 9 shows a third paper manufacturing line where the cycle of winding shafts 1 and machine reels 4 between a winder 20 and a slitter-winder 30 is implemented in a manner corresponding to FIG. 8.

The winding shafts 1 may be lifted with a hoist to an interim storage 35 above the winder 20. A machine reel 4 may be moved with a chassis 11 from the windup station 20, e.g., sideways in the lateral direction. A winding shaft 1 can be moved with a chassis 11, for example, in the direction of the machine line from the unwinding station 31 to the windup station 20.

In FIG. 9, the pressure supply of air cushion elements 40 of the support chassis 11 is arranged through the transfer device 15. Pressurized air is used as the pressurized gas, the supply of which may be controlled on and off depending on the position of the chassis during transfer. The movable support apparatus 10 comprises an inlet for pressurized air, which can be connected to a pressurized air supply external to the support apparatus. The pressurized air supply comprises a pressure hose 17 moved away from floor level. The pressure hose 17 leads to the transfer device 15 from a pressurized air path 60, which is supported on the walls of the building or on transfer paths 61 supported on posts. The pressurized air path 60 is preferably arranged below hoist rails and separately from the structures of the hoist. The pressurized air path 60 movable in the longitudinal direction on the transfer paths 61 comprises, e.g., a beam 60 on which is fitted a hose reel 62 or a pressure hose storage 62 adapted to be sliding in the transverse direction to the manufacturing line.

It is possible to carry out a turn of a machine reel 4 in place in a space equal to the support apparatus 10 if it is desired to change the unwinding direction, for example. Thereby, the use of a hoist is minimized and a rotating beam is not needed as an accessory of the hoist for the handling of machine reels.

The machine reels 4 and/or winding shafts 1 on a chassis 11 and empty chassis 11 can be stored densely independently of machine lines, among other things. The storage and transfer area of the chassis 11 may be physically defined to confine the chassis within.

The movable support apparatus 10 enables moving and storing a machine reel 4 fully freely in the desired area (with a floor having a sufficient load-carrying capacity); the chassis 11 may be turned by, e.g., 90 degrees, whereby machine reels 4 can be moved along a narrow passage. Furthermore, machine reels 4 may be stored in a desired area in an arbitrary direction or in arbitrary places within the machine hall and outside the machine hall. An interim storage of machine reels 4 can also be increased taking reels to premises in the driving side/another hall 71 and/or a corridor 72 of the tending side as well. In FIG. 9, machine reels are stored on chassis 11 outside the machine hall in premises 71 behind a wall 70, which premises are not within reach of a hoist. Empty chassis 11 are stored in the same premises 71 at the side of the machine hall, packed in a small space side by side next to the wall 70.

Figure 10:
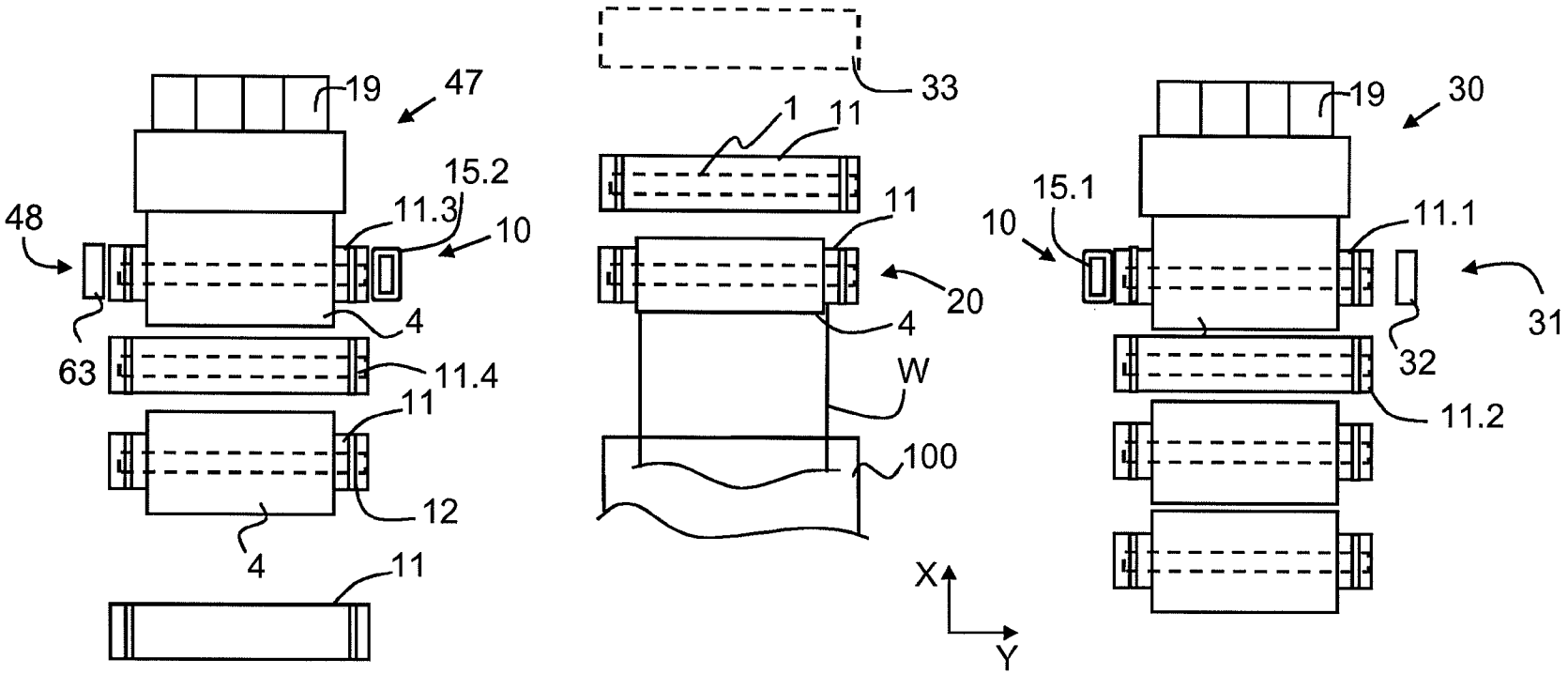
FIG. 10 shows a fourth paper manufacturing line.

FIG. 10 shows a fourth paper manufacturing line. The example in FIG. 10 illustrates a cycle of machine reels 4 and winding shafts 1 implemented by means of two transfer devices. The manufacturing line of FIG. 10 comprises a windup 20, a first unwinder 31, a first slitter-winder 30, a second unwinder 41 and a second slitter-winder 47 as the main devices of the process. Ten chassis 11 and two transfer devices are used as unwind stands of machine reels 4 and winding shafts 1, for a transfer purpose and as storage stands at the dry end of the paper manufacturing line. Naturally, the two slitter-winders may also only be served using one transfer cart.

The first transfer device 15.1 may be used to move a machine reel 4 wound around a first winding shaft on a first support chassis 11.1 from a windup station 20 to a first unwinding station 31. A drive 32 in the unwinding station 31 may be connected to the machine reel with a movement of the coupling of the drive or with a movement of the first support chassis 11.1. After this, the first transfer device 15.1 may be connected to a second chassis 11.2, on which a second winding shaft partly or wholly emptied at the unwinding station 31 is located. The first transfer device 15.1 may be used to move the machine reel on the second chassis to wait at the unwinding station 31 or to any reject location 33 in the process area to be unwound into a pulper.

The second transfer device 15.2 may be used to move a machine reel 4 wound around a third winding shaft on a third support chassis from a windup station 20 to, e.g., a second unwinding station 48 on the other side of the winder 20. A second drive 63 in the second unwinding station 48 may be connected to the machine reel 4 with a movement of the coupling of the drive or with a movement of the third support chassis 11.3. After this, the second transfer device 15.2 may be connected to a fourth chassis 11.4, on which a fourth winding shaft unwound at the second unwinding station 48 is located. The second transfer device 15.2 may be used to move a fourth winding shaft to, e.g., the windup station 20, from which a machine reel 4 wound around a winding shaft has been removed with the first transfer device 15.1, and the cycle can be continued further. Flexibility in terms of storage space can be arranged by means of chassis 11 on the floor and corridors of the machine hall. The utilization degree of the transfer device 15 can be made high when payload can be transferred using the chassis 11 in both outgoing and incoming directions. For example, when moving in one direction, the chassis 11 holds a full machine reel 4, and when moving in the other direction, the chassis 11 holds an empty winding shaft.

The winding stations 20, 31, 41 have drives and a possibility to deviate the reel in the lateral direction either throughout the winding or at one time as a lateral shift before beginning the winding. The maximum range of the lateral shift is preferably arranged to be +−50 mm. A lateral shift implemented using the oscillation elements 50 of the type described above may be integrated as a function of a winding stand 11.

It should be emphasized that the enclosed description only concerns examples of implementing a movable winding stand and a machine reel process.

Figure 11:
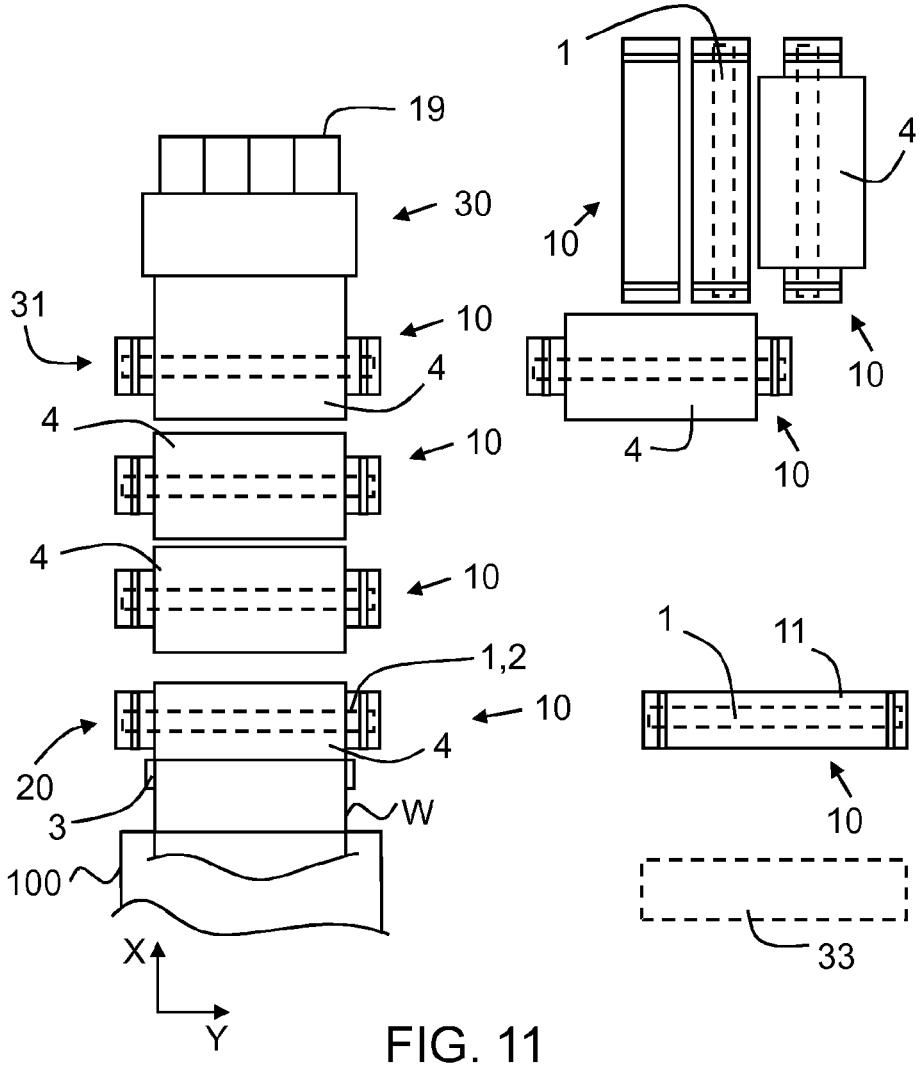
FIG. 11 shows a top view of the dry end of a fifth paper manufacturing line, where a machine reel is wound, machine reels and winding shafts are moved at different stages of the process and the machine reel is unwound on the same winding stand.
Figure 12:
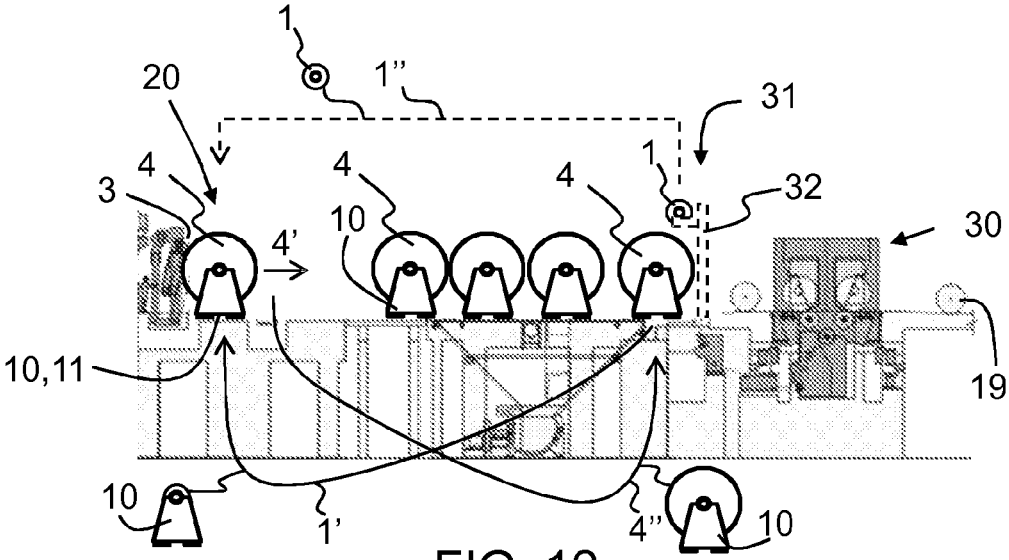
FIG. 12 shows a side view of a paper manufacturing line of the type of FIG. 11, where empty winding shafts can be moved with lifting devices and a hoist.

The fiber web manufacturing lines shown in FIGS. 11 and 12 comprise a fiber web machine such as a paper machine 100 and a windup 20 in line with it and a slitter-winder 30. A paper web W being output from the paper machine 100 is wound in the windup 20 by means of a winding cylinder 3 into a machine reel 4 around a winding shaft 1.

The manufacturing line shown in FIG. 11 comprises the windup 20, an unwinder 31 and the slitter-winder 30 as the main devices of the process.

Automatic splicing devices and automatic splicing methods suitable for movable winding stands 10 can be used at the unwinder 31 and the windup 20 in order to reduce the number of manual work phases and the amount of manual work when a machine reel 4 is exchanged and in order to shorten the idle time of such machines as an offline calender and a slitter-winder.

A winding shaft 1 at the different stages of the machine reel process can be moved on a winding stand to a reject location 33 anywhere in the process area to be unwound into a pulper.

Depending on the paper manufacturing process, e.g. the paper grade manufactured, flexibility may be needed in terms of storage space on a case-by-case basis for full machine reels, partially filled machine reels, reject reels, winding shafts. It is possible to create flexibility in terms of storage space by means of movable winding stands 10 supported on a floor and based on air cushion technology. The movable winding stand 10 comprises a support chassis 11 for holding up a load, supported movably on a floor through air cushion elements 40 and described in more detail with reference to FIGS. 3 to 6.

In accordance with some embodiments, the winding stand 10 comprises a support chassis 11 into which the devices necessary for moving the winding stand are integrated. In accordance with some embodiments, the winding stand 10 comprises a separate transfer device 15, which can be detachably connected to the support chassis 11, for moving the chassis 11.

An oscillation mechanism for a machine reel 4 may be integrated into the movable winding stand 10. A lateral shift device for a machine reel 4 may be integrated into the movable winding stand 10. A splicing apparatus for a machine reel 4 may be integrated into the movable winding stand 10. Winding stand locking devices may be integrated into the movable winding stand 10.

It is possible to arrange storage and transfer capacity for machine reels 4 and winding shafts 1 by applying the preferred embodiments of the winding stand 10 presented in the following and by modifying said preferred embodiments to a suitable extent. For example, short-term storage capacity for machine reels 4 and winding shafts 1 can be arranged so that by simultaneously using dense positioning of main devices and locating machine reel and/or winding shaft storages away from between the main devices a short manufacturing line can be provided, enabling the use of a short machine hall. By applying embodiments of the winding stands 10, it is in some cases possible to do without a full-scale hoist, even without any hoist, whereby the machine hall and the building may be constructed to be lower than usual.

In FIGS. 11 and 12, the machine reel 4 traffic between a windup 20 and an unwinder 31 is arranged using movable winding stands 10. In the application shown in FIG. 11, a winding stand 10 enables moving winding shafts 1, machine reels 4 and rolls and implementing their storage, for example, in an aisle or corridor of the building. The movable winding stand 10 may be used to arrange the turning of loads in place, e.g., in order to change the winding direction or to position winding stands 10 close to one another in order to save space.

It is recommended that a number of machine reels 4 and/or winding shafts 1, within the tolerance of the manufacturing process, are located in storage to be away from the immediate vicinity of the main devices of the manufacturing line, especially from between the main devices, in order to provide a layout solution that takes as little room as possible in the longitudinal direction of the building.

In FIG. 11, the winding stands 10 of a machine reel 4 and a winding shaft 1 enable the machine reel or the winding shaft to be brought to the winding location from a lateral direction. This is a significant advantage and a cost-reducing factor if it is desired to implement the logistics of the dry end cost-efficiently, e.g., without hoist operations in a light-structured hall.

In the following examples illustrating the handling systems of winding shafts, machine reels and/or rolls, a machine reel 4 or a winding shaft 1 is moved or lowered to a winding stand 10 to be moved further in the process.

FIG. 12 shows a handling solution for machine reels 4 and winding shafts 1 implemented using movable winding stands 10 in accordance with some embodiments at a windup 20 of a calender and at a slitter-winder 30. A machine reel 4 is wound at a winding stand 10, moved to an unwinding station 31 of a slitter-winder preferably using the same winding stand 10 and the winding shafts 1 are returned preferably using the same winding stand 10 to the windup station 20 of the calender or another necessary windup station.

A machine reel 4 can be moved with a winding stand 10 from the windup station 20 in the direction of the machine line in the way shown by arrow 4'. A machine reel 4 can also be moved with a winding stand 10 from the windup station 20, e.g., sideways in the lateral direction in the way shown by arrow 4". The unwinding order of the machine reels 4 can be changed. A machine reel 4 can be moved with a winding stand 10 to the unwinding station 31 in the direction of the machine line in the way shown by arrow 4'. A machine reel 4 can also be moved with a winding stand 10 to the unwinding station 31, e.g., sideways in the lateral direction in the way shown by arrow 4".

A winding shaft 1 may be moved with a winding stand 10 in the direction of the machine line backwards from the unwinding station 31 . The winding shaft 1 may also be moved with a winding stand 10 in the lateral direction from the unwinding station in the manner shown by arrow 1'. When the windup 20 and the unwinder 31 are equipped with lifting devices and storage locations for a winding shaft 1, the winding shaft 1 may also be moved over the top with lifting devices and, e.g., a lightweight hoist in the manner shown by arrow 1" indicated by a dashed line. The dashed line 32 indicates the lifting device of the unwinding station 31 and the storage location for the winding shaft 1.

FIGS. 3, 4 and 5 above show examples of a movable winding stand 10.

FIGS. 13 to 16 show a winder 20, where the fiber web W is wound by means of a winding cylinder 3 counterclockwise when viewed from the tending side in the direction of the driving side into a machine reel 4 on a winding shaft 1, which is locked on a movable winding stand 10. The winder 20 may preferably comprise an auxiliary drive 23 used at an offline calender and moved 23' at the tending side in the machine direction with guides, the auxiliary drive 23 being connected to the shaft end 2 of a machine reel 4 when the machine reel is preferably slowed down to crawling speed with the winder's a main drive 24 at the driving side. In connection with the winder 20, there is a winding shaft storage 21, from which an empty winding shaft may be moved with a transfer device 22 to an empty winding stand 10 at the winding station.

Figure 13:
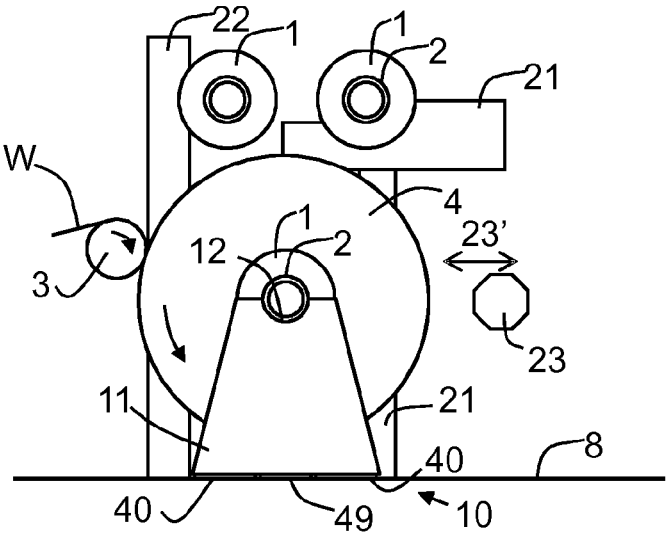
FIGS. 13 to 16 show a side view of a first machine reel exchange sequence at a windup.

In FIG. 13, the winding stand 10 has been lowered to be supported by a mating surface 49 by means of pressurized air elements 40 intended for the transfer of the winding stand. The winding stand 10 may be locked to rest on the mating surfaces 49 by locking to, e.g., the oscillation mechanisms 50 described above or a transfer device which is able to move in a machine direction at a winding station and which is fitted to a floor 8.

Figure 14:
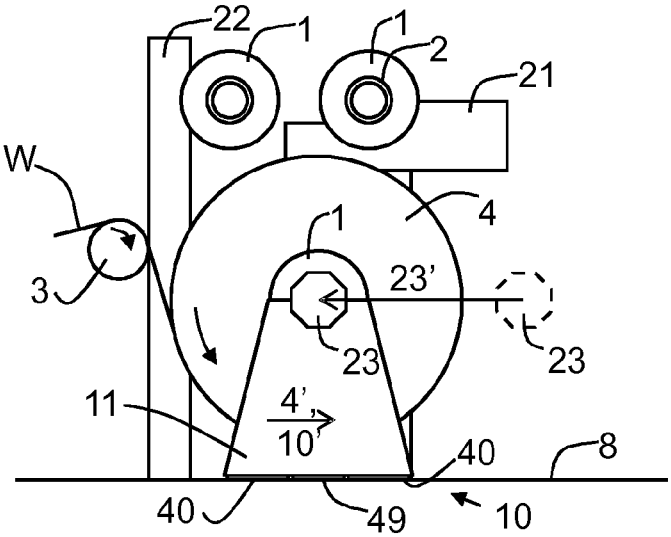

In FIG. 14, the auxiliary drive 23 has been connected to rotate a machine reel 4 and the main drive 24 has been disconnected. The winding stand 10 has been moved in the machine direction off the winding cylinder 3 (arrow 4', 10'). The auxiliary drive may be used at a windup of a calender.

Figure 15:
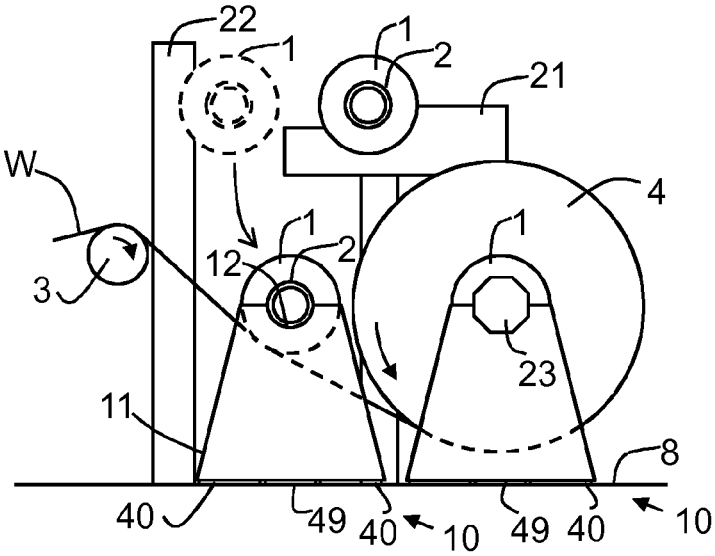

In FIG. 15, the machine reel 4 and the first winding stand 10 has been moved enough so that it has been possible to move a second winding stand 10 from the lateral direction to the winding station without a winding shaft. The fiber web W moving at crawling speed has most suitably been lifted or held up at a level above the height of the second winding stand 10 during the lateral transfer so that the vertical section of the driving side of the winding stand does not harm the web. The holding up of the web may be carried out, e.g., by means of a movable beam transverse to the web. The winding shaft 10 has been locked to the winding station. A winding shaft 1 has been moved from a winding shaft storage 21 with a transfer device 22 to a winding stand 10 and locked in a rotatable state. The main drive 24 has been connected to a shaft end 2 at the other side to rotate the winding shaft 1 at crawling speed.

Figure 16:
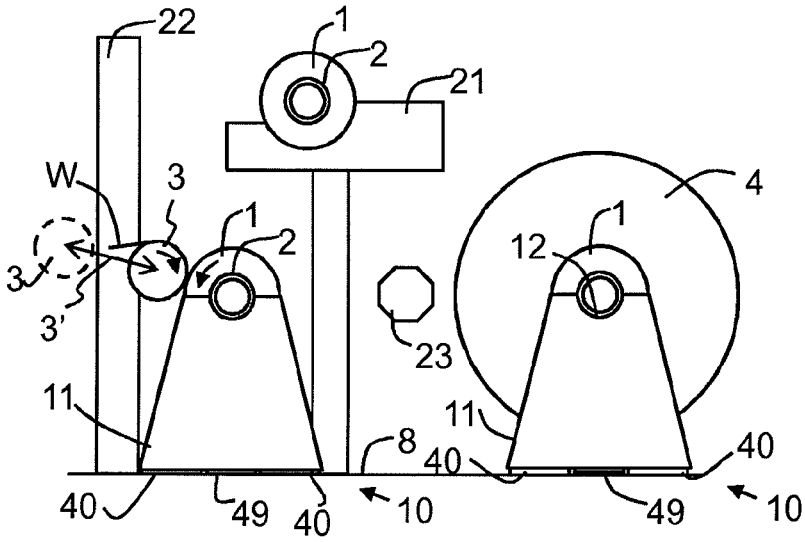

In FIG. 16, a winding nip between a winding cylinder 3 and a winding shaft 1 has been closed with a transfer movement 3' of the winding cylinder 3 so that the web W remains in between. The web W has been cut, e.g., by cutting a wedge in the web by means of a water cutting turn-up device after which the web is wound around a winding shaft 1. After this, the machine reel 4 may be wound using the main drive 24. After the cutting of the web W, the auxiliary drive 23 has been used to brake the first machine reel 4 to a halt and the auxiliary drive has been disconnected. The auxiliary drive 23 has been driven to its standby station. The locking of the first winding stand 10 on the mechanisms fitted to the floor 8 has been opened and the air cushion elements 40 have been pressurized for the transfer of the winding stand 10 and the machine reel 4.

FIGS. 17 and 18 show a winder 20, where a fiber web W is wound by means of a winding cylinder 3 clockwise when viewed from the tending side to the direction of the driving side into a machine reel 4 on a winding shaft 1, which is locked to a movable winding stand 10. In the figures, the web miming path W runs below the winding cylinder 3 on the left from the winding shaft 1 and revolves clockwise around the winding shaft 1. Compared with the windup process shown in FIGS. 13 to 16, the windup direction has been changed in FIGS. 17 and 18. In the solution shown in FIGS. 17 and 18, the unwinding direction of the machine reel 4 must be changed as necessary. In order to change the unwinding direction, the machine reel 4 can be turned in a suitable position on the winding stand 10.

A second winding stand 10 and a winding shaft 1 locked on the second winding stand 10 are moved to a windup 20 from the lateral direction in the space between a machine reel 4 rotating on a first winding stand 10 and a winding cylinder 3 after an auxiliary drive 23 has been connected to rotate the machine reel 4 (e.g. in an offline calender application), a main drive 24 is disconnected and the first winding stand 10 is moved in the machine direction off the winding cylinder 3. The loading pressures of air cushion elements 40 of the second winding stand 10 are discharged and the second winding stand 10 is locked in connection with the floor 8 as described above.

In FIG. 18, the windup of a new machine reel 4 and the transfer of a ready machine reel 4 with the first winding stand 10 has been begun, e.g., according to the principle described above in connection with FIG. 16, but the cutting devices of the web W and the devices needed for lifting it to the winding shaft 1 are preferably located in an inverse manner with respect to the prior art solution shown in FIG. 16, or water turn-up device techniques may be applied.

Figure 19:
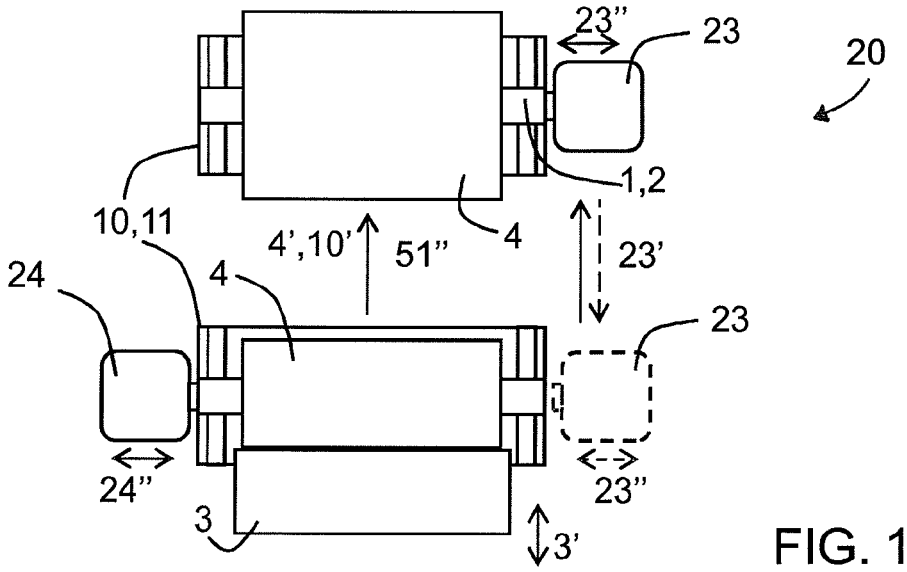
FIG. 19 shows a top view of a machine reel exchange at a windup.

FIG. 19 shows a top view of a part of a machine reel 4 exchange sequence implemented using a winding stand 10 at a windup 20. The fiber web is wound by means of a winding cylinder 3 movable 3' in the machine and/or vertical direction around a winding shaft 1 on a movable winding stand 10 into a machine reel 4. During the winding, a coupling of a main drive 24 of the winder 20 is connected to the winding shaft 1 on the driving side, e.g., with a movement of the coupling 24".

In a machine reel 4 exchange situation, an auxiliary drive 23 on the tending side is moved with a longitudinal movement 23' of the auxiliary drive to the machine reel 4 and the auxiliary drive 23 is connected, e.g., with a movement 23" of the coupling of the auxiliary drive to rotate the machine reel 4 from a shaft end 2 of the tending side. After this, the coupling of the main drive 24 is disconnected with a movement 24". The winding stand 10 and the machine reel 4 are moved in the machine direction 51" (4', 10') off the winding cylinder 3, while the auxiliary drive 23 follows along connected to the machine reel 4. While the machine reel 4 still rotates, the web is cut and winding can be continued around another winding shaft on a second winding stand brought to the vacated space. The auxiliary drive 23 equipped with a brake function is used to brake the rotating movement of the full machine reel 4 to a halt and the coupling of the auxiliary drive is disconnected with the movement 23".

Figure 20:
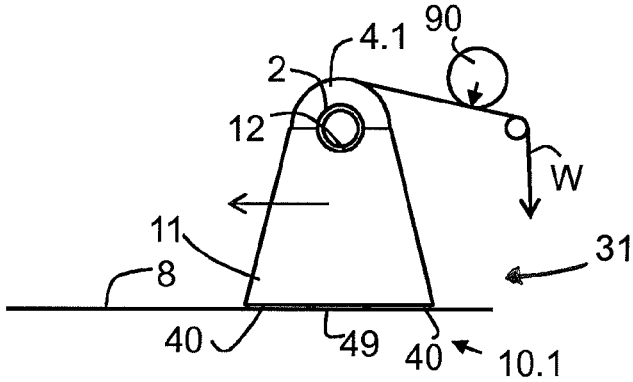
FIGS. 20 and 21 show a side view of a machine reel exchange sequence at an unwinder.
Figure 21:
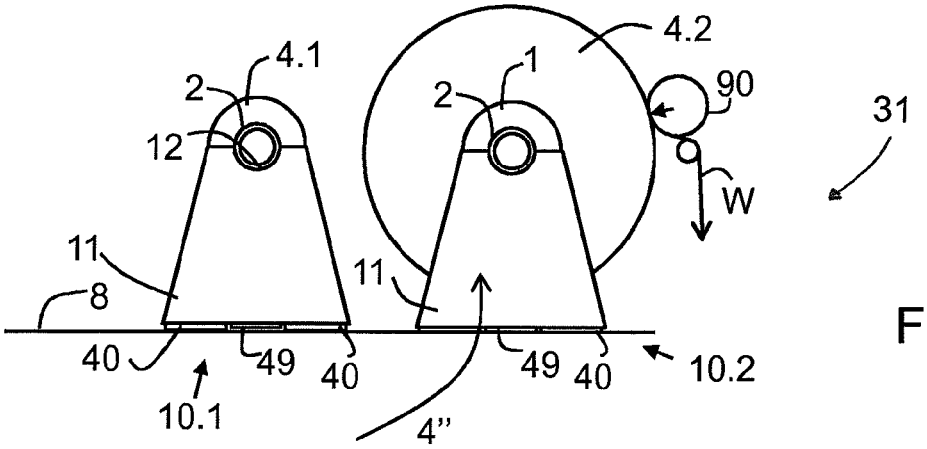

FIGS. 20 and 21 show a side view of an exchange sequence of a machine reel at an unwinder 31. In FIG. 20, a first machine reel 4.1 to be unwound is revolvingly locked to a first winding stand 10.1, which is locked in connection with a floor 8, e.g., through oscillation mechanisms. At the end of the unwinding of the first machine reel 4.1, after a slow down of the rotating movement, the web running path W is placed on hold at a splicing device 90.

After this, the web W will be cut to make a butt joint or a lap joint with a web W unwound from the second machine reel 4.2. Then the coupling of a drive (brake generator) of the unwinding station is disconnected from a shaft end 2 of the winding shaft 1 of the machine reel 4.1. The locks of the unwinding station are detached from the winding stand 10.1 and the winding stand 10.1 is moved away from the unwinding station backwards in the direction of the machine line (alternatively in the lateral direction).

In FIG. 21, the first winding stand 10.1 has been moved away from the unwinding station in the direction of the machine line, e.g., on air cushion elements 40. The second machine reel 4.2 has been brought to the unwinding station on the winding stand 10.2 from the lateral direction 4" (alternatively this may take place from the direction of the machine line), the second winding stand 10.2 has been locked and the coupling of the drive of the unwinding station has been attached to the second machine reel 4.2. The web W on hold at the splicing device 90 is spliced to the web W of the machine reel 4.2. After the splicing the machine reel 4.2 can be unwound at the unwinding station.

An unwinder solution implemented using a movable winding stand 10 is to handle winding shafts 1 with lifting arms of a splicing unwinder of a calender and to return the winding shafts from the lifting arms to a windup or a reject station or a winding stand (not shown in the figures).

Figure 22:
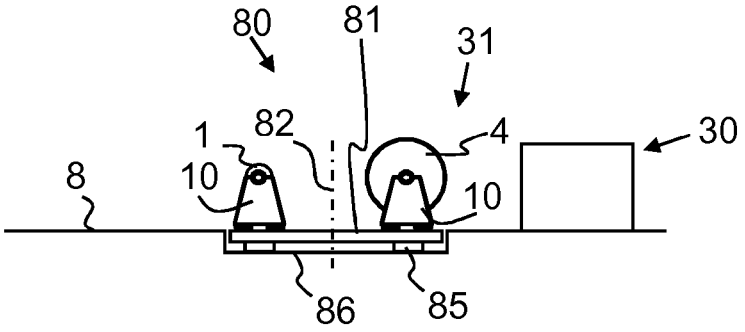
FIGS. 22 to 24 show a transfer of a machine reel on a winding stand by means of a rotary table.
Figure 23:
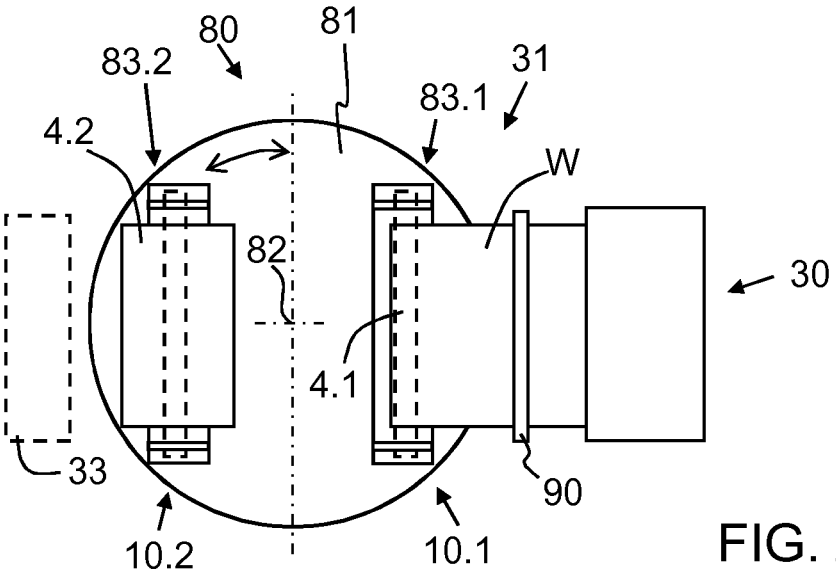
Figure 24:
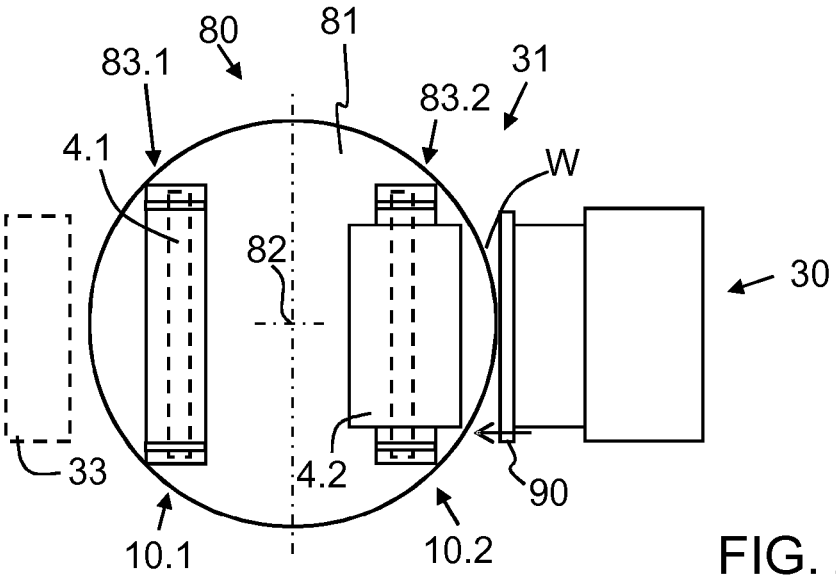

FIGS. 22 to 24 show a transfer of a machine reel 4 by means of a rotary table 80 supported by a winding stand 10. The winding stand 10 is shown without a transfer device 15 detachably connected to a support chassis 11 of the winding stand 10 but, according to some embodiments, the winding stand 10 may be transferred with a movable transfer device 15 to and away from the rotary table 80. The rotary table 80 preferably comprises a plane-like frame 81, which is rotatable around a vertical swiveling axis 82 so that a winding shaft and/or machine reel on the winding stand 10 is moved by a circular movement to an unwinding station 31 or another station of the machine reel process at different stages of the winding process. The winding stand 10 can be moved from a floor 8 by driving into one of the positioning stations 83 at a support plane above the frame 81 and locked in place for the different stages of the winding process. The positioning stations 83 of the rotary table 80 are preferably located evenly spaced on top of the frame 81, whereby each positioning station 83 can be aligned with some stage of the winding process by turning the frame 81 by an angle corresponding to said spacing distance. A stage of the winding process here refers to, e.g., winding, unwinding, and rejecting.

As an advantage of using the rotary table 80, a fewer number of transfer devices 15 can be used if the transfer of the winding stand 10 is implemented using transfer devices 15. A transfer device 15 is freed for, e.g., a windup 20 when the rotary table 80 is used for moving the winding stand 10 to an unwinder 31. A machine reel exchange sequence can become quick by means of the rotary table 80. A reject location 33 of a machine reel 4, e.g. a pulper opening, may be located away from the transfer of the winding stand 10, and thus the pulping of the bottom end of the machine reel 4 does not hamper other operations. Several slitter-winders 30 (unwinding stations 31) may be located at the rotary table 80. The slitter-winders may be operated in synchronization, in other words, the exchange of a winding stand 10 may be performed in synchronization with the turning times of the rotary table 80, or then, e.g., only one slitter-winder may be driven.

FIG. 22 shows a preferred application of a rotary table 80, where air cushion elements 85 are fitted below a preferably circular frame 81 for moving the frame on a support surface 86. In addition to or instead of the air cushion elements 85, other modes of support may also be used to move the frame on the support surface 86. The support surface 86 may be located, e.g., in a cavity provided at floor 8 level. The locking in place of the frame 81 may be implemented using conventional methods, but the lifting and lowering movement of the air cushion elements 40 may be utilized in the locking of the frame 81. The frame 81 and the support surface 86 may comprise a cone locking between them, utilizing lifting and lowering movements.

FIGS. 23 and 24 show a top view of the rotary table 80 of FIG. 22, where an unwinding station 31 and a pulper opening 33 of a reject location are arranged on opposite sides of its frame 81. FIGS. 23 and 24 show a machine reel exchange sequence. In FIG. 23, a first winding stand 10.1 is locked to the frame 81 in a first positioning station 83.1, which has been turned to the unwinding station 31. A first machine reel 4.1 is being unwound at the first winding stand 10.1. A second machine reel 4.1 can be simultaneously brought, prepared and locked on a second winding stand 10.2 to a second positioning station 83.2 in good time before the start of the machine reel 4 exchange sequence. In the unwinding station 31 the web W is placed on hold at a splicing device 90.

After this, the web W is cut in order to subsequently make a butt joint or a lap joint. A coupling of a drive of the unwinding station 31 is disconnected from the first machine reel 4.1. The locking of the rotary table 80 is opened and the frame 81 is turned in this case by 180 degrees around its swiveling axis 82.

In the situation shown in FIG. 24, compared with the situation in FIG. 23, the frame 81 has been turned by 180 degrees around its swiveling axis 82, the locking of the rotary table 80 has been closed and the coupling of the drive of the unwinding station 31 has been attached to the second machine reel 4.2. After the splicing of the web W begun at the splicing device 90, the machine reel 4.2 can be unwound at the unwinding station 31 and slit with the slitter-winder 30. The pulping of the bottom ends of the first machine reel 4.1 may be carried out into the pulper opening 33 during the unwinding, which increases the capacity of the process.

Figure 25:
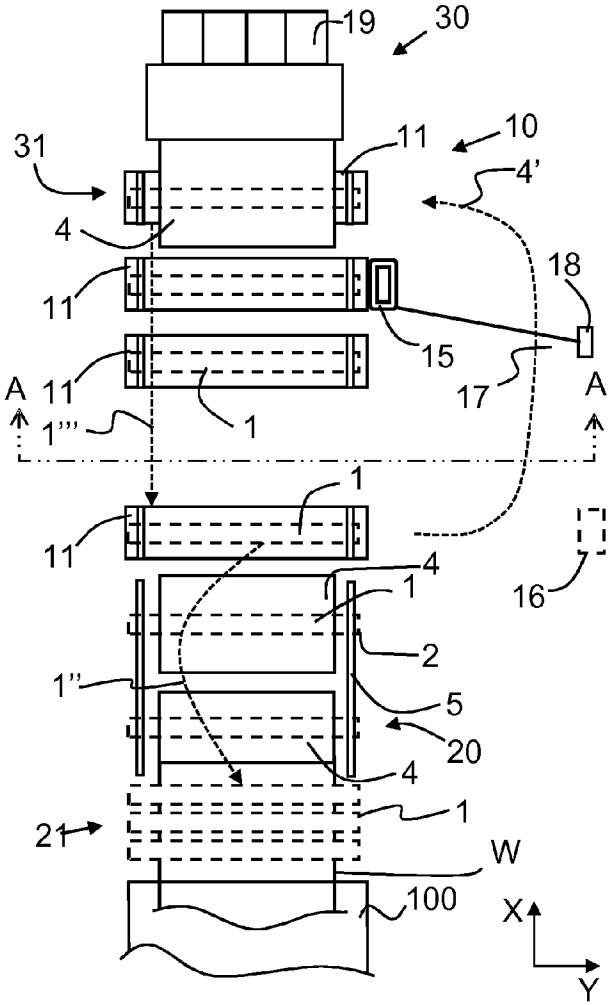
FIG. 25 shows a sixth paper manufacturing line.

FIG. 25 shows a sixth paper manufacturing line where winding stands 10 have been used for the transfer of machine reels 4 from transfer rails 5 in connection with a winder 20 to an unwinder 30 and for the unwinding of a machine reel 4 at an unwinding station 31. The winding stand 10 may comprise an apparatus used by the user as an integrated unit, or it may operate automatically. Alternatively, the winding stand 10 additionally comprises a transfer device 15, which is connected to a support chassis 11 so that the chassis 11 can be steered under the control of the transfer device 15 during transfer. In the example shown in FIG. 25, the support chassis 11 of a winding stand 10 moved with the transfer device 15 is used to move a machine reel 4 to an unwinding station 31 (arrow 4'), as an unwind stand at the unwinding station 31, and as a transfer chassis of empty winding shafts 1, moved with the transfer device 15 near a winder 20 (arrow 1''').

The rail gates 6 shown in FIG. 4 can be used when loading a machine reel 4 from transfer rails 5 to a winding stand 10. The winding shafts 1 may be lifted, e.g., with a light hoist to an interim storage 21 above the winder 20 (arrow 1"). A machine reel 4 can be moved with an unwind stand 10 from the windup station 20 sideways in the lateral direction, for example, in the way shown by arrow 4'. A winding shaft 1 can be moved with an unwind stand 10, e.g., backwards in the direction of the machine line from an unwinding station 31.

In FIG. 25, the area above the line A-A shows the area of the machine hall at the dry end of the manufacturing line that is not necessarily in the operating area of a hoist. The height of the machine hall below the line A-A enables the operation of a hoist and the lifting of loads with a hoist. When the transfer of machine reels 4 and reel spools 1 takes place with winding stands 10, a hoist is not needed and the hall may be a lower "lightweight hall" in the area above the line A-A. A home station 16 of the transfer device 15 may be close to the wall of the tending side or, e.g., at the side the winder 20.

In FIG. 25, the pressure supply of air cushion elements 40 of the support chassis 11 is arranged through the transfer device 15, but the pressure supply can equally well be implemented directly to the support chassis 11. Pressurized air is used as the pressurized gas, the supply of which may be controlled on and off depending on the position of the chassis during transfer. The movable support apparatus 10 comprises an inlet for pressurized air, which can be connected to a pressurized air supply outside the support apparatus and is implemented through a pressure hose 17 running at floor level, preferably by means of a hose reel 18.

Figure 26:
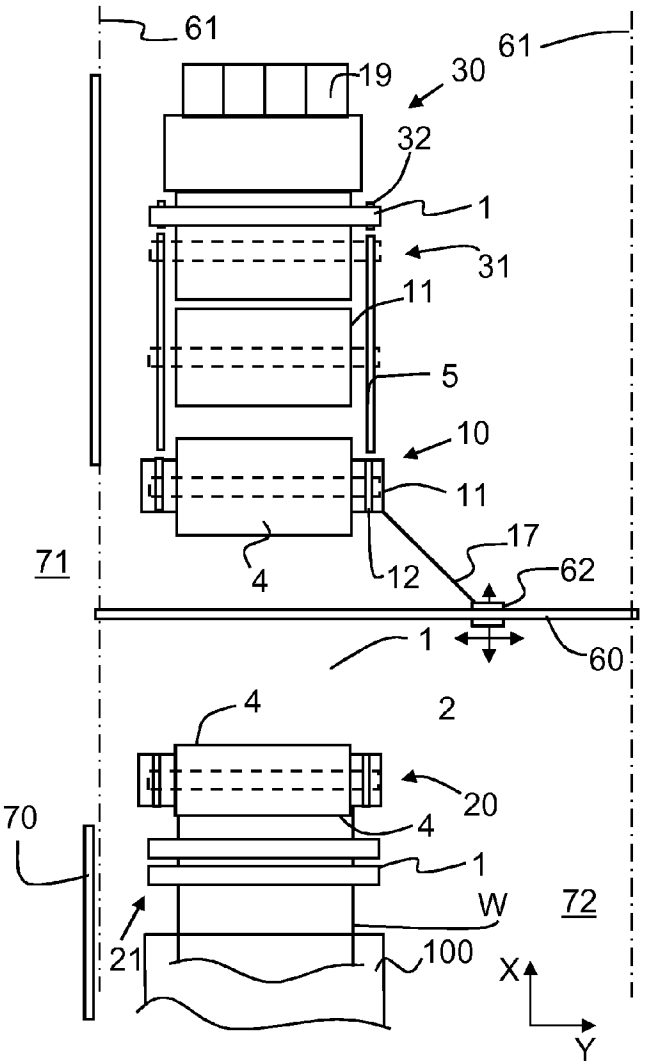
FIG. 26 shows a seventh paper manufacturing line.

In the paper manufacturing line shown in FIG. 25 and FIG. 26, winding stands 10 may also be used as machine reel 4 and/or winding shaft 1 storage stands, which enables dynamic operation of the storage; e.g., machine reels 4 can be moved forward in the process regardless of the manufacturing order.

FIG. 26 shows a seventh paper manufacturing line, where the transfer of machine reels 4 from a windup 20 to transfer rails 5 of an unwinding station 31 of a slitter-winder 30 is implemented using a windup stand 10.

Winding shafts 1 may be lifted from the unwinding station 31, e.g., from a storage location of a lifting device 32 with a hoist to an interim storage 21 above a winder 20 or directly to a windup stand 10. A machine reel 4 may be moved with a windup stand 10 from the windup station 20, e.g., sideways in the lateral direction or in the direction of the machine line.

In FIG. 26, the pressure supply of air cushion elements 40 of the windup stand 10 is arranged through a support chassis 11. Pressurized air is used as the pressurized gas, the supply of which may be controlled on and off depending on the position of the chassis during transfer. The movable winding stand 10 comprises an inlet of pressurized air, which can be connected to a pressurized air supply outside the support apparatus. The pressurized air supply comprises a pressure hose 17 moved away from floor level. The pressure hose 17 leads to the winding stand 10 from a pressurized air path 60, which is supported on transfer paths 61 supported on the walls of the building or on posts. The pressurized air path 60 is preferably arranged below hoist rails and separately from the structures of the hoist. The pressurized air path 60 movable in the longitudinal direction of the manufacturing line on transfer paths 61 comprises, e.g., a beam 60 on which is fitted a hose reel 62 or a pressure hose storage 62 adapted to be sliding in a transverse direction to the manufacturing line.

It is possible to carry out a turn of a machine reel 4 in place in a space equal to the extent of the windup stand 10 if it is desired to change the unwinding direction, for example. Thereby, the use of a hoist is minimized and a rotating beam is not needed as an accessory of the hoist for the handling of machine reels.

Machine reels 4 and/or winding shafts 1 on a winding stand 10 and empty winding stands 10 can be stored densely independently of machine lines, among other things. The storage and transfer area of the chassis 11 may be physically defined to confine the chassis within it.

The movable winding stand 10 enables moving and storing a machine reel 4 fully freely in a desired area (with a floor having sufficient load-carrying capacity); the winding stand 10 may be turned by, e.g., 90 degrees, whereby machine reels 4 can be moved along a narrow passage. Furthermore, machine reels 4 may be stored in a desired area in an arbitrary direction or in arbitrary places within the machine hall and outside the machine hall. An interim storage of machine reels 4 can be increased by taking reels into premises on the drive side/another hall 71 and/or a corridor 72 of the tending side as well.

Figure 27:
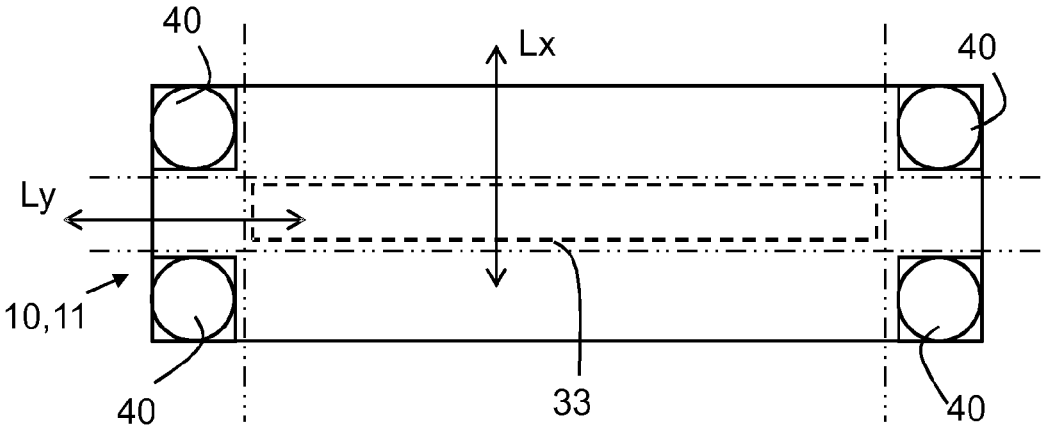
FIG. 27 shows a position of a pulper opening in relation to a movable winding stand.

FIG. 27 shows a preferable location of a pulper opening 33 in relation to air cushion elements 40 of a winding stand 10 serving as a movable support apparatus. A machine reel cart/winding stand 10 is able to move over a pulper opening 33 when the air cushion elements 40 are located, e.g., in the way shown in FIG. 27 in relation to the pulper opening 33.

FIG. 27 shows a machine reel cart/winding stand 10 corresponding to FIG. 5 and a pulper opening 33 with a dashed line. In the machine reel cart/winding stand 10, air cushion elements 40 are located in a chassis 11 so that the pulper opening 33 can be crossed in the longitudinal direction Lx of the pulper opening and the transverse direction Ly of the pulper opening. In FIG. 27, the spacing of the air cushion elements 40 is wider than the width and length of the pulper opening. Naturally, such embodiments of a machine reel cart/winding stand 10 are also possible where the pulper opening 33 can only be crossed in one direction, whereby the spacing of the air cushion elements 40 is wider than the size of the pulper opening (width or length) only in the crossing direction.

Figure 28:
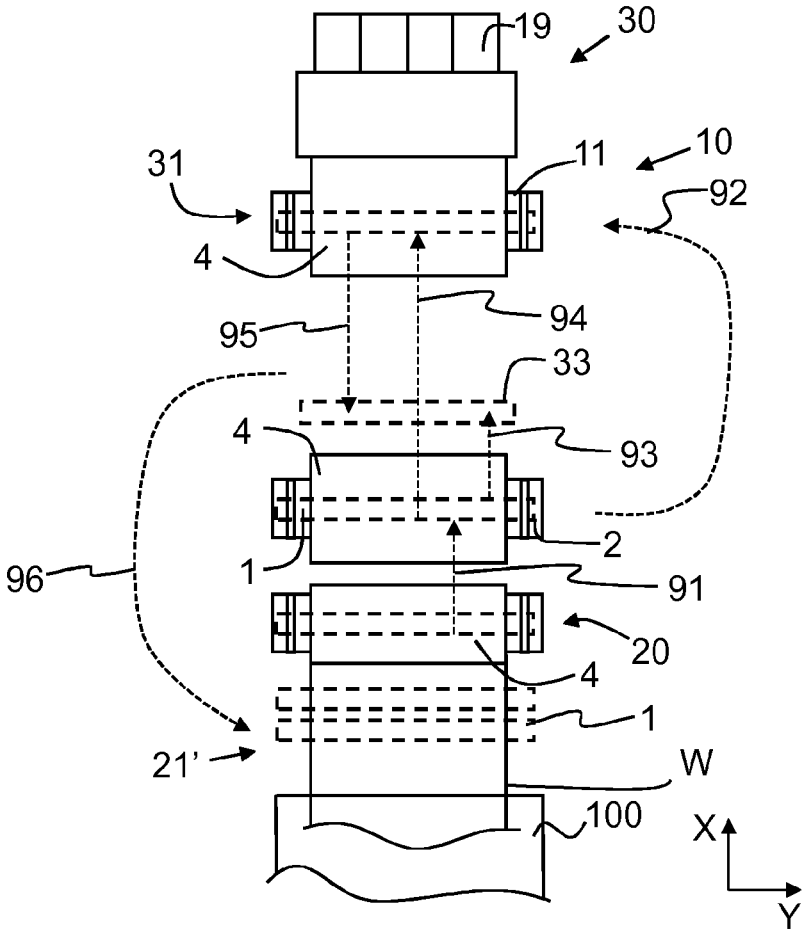
FIG. 28 shows an eighth paper manufacturing line.

FIG. 28 shows an eighth paper manufacturing line where winding stands 10 have been used for the winding of machine reels 4 at a winder 20, the transfer of machine reels 4 from the winder 20 to a slitter-winder 30 and the unwinding of machine reels 4 at an unwinding station 31.

A pulper opening 33 is located between the windup 20 and the slitter-winder 30 in accordance with FIG. 28. Thereby, the bottom end reject potentially remaining on the winding shaft 1 at the unwinder 31 of the slitter-winder 30 and the partially filled machine reels 4 generated at the paper machine due to web breaks can be rejected in the same place and utilizing a minimum movement distance, which saves the time of the operators and the transfer energy of the machine reel cart.

A machine reel 4 is moved at a winder 20 with a first transfer movement 91 so that the next machine reel 4 can be wound. After this, the machine reel 4 can be moved with a winding stand 10 from the windup station 20, e.g., in the lateral direction and further sideways to the unwinding station 31 with a second transfer movement 92; or the machine reel 4 can be transferred with a third transfer movement 93 in the machine direction to the reject location 33; or the machine reel 4 can be moved with a fourth transfer movement 94 in the machine direction across the pulper opening 33 of the reject location to the unwinding station 31. A winding shaft 1 may be moved with a winding stand 10, e.g., in the direction of the machine line backwards from the unwinding station 31 with a fifth transfer movement 95. Thereby, a partially emptied machine reel 4 may be emptied fully at the reject location 33 after the short transfer movement 95.

Empty winding shafts 1 emptied to the pulper opening 33 at the unwinder 31 or the reject location can be moved with a sixth transfer movement 96 of the winding stand 10 to a turned storage 21' preceding the windup 20. FIG. 28 shows an example of a turned storage 21' of winding shafts arranged at a winder 20 below the web running path W coming to the winder 20. A known storage of winding shafts 1 above the winder 20 is possible with the winder 20 of FIG. 28. A machine reel 4 can be moved with a winding stand 10 from the windup station 20, e.g., in the lateral direction and further sideways to the unwinding station 31 in the way shown by arrow 92.

A winding shaft 1 may be moved with a winding stand 10, e.g., in the direction of the machine line backwards from the unwinding station 31. Thereby, a partially emptied machine reel 4 may be emptied fully at the reject location 33 after a short transfer movement.

In the paper manufacturing line in FIG. 28, winding stands 10 may also be used as machine reel 4 and/or winding shaft 1 storage stands, which enables dynamic operation of the storage; e.g., machine reels 4 can be moved forward in the process regardless of the manufacturing order.

The machine reel 4 and air cushion elements 40 can be located so that the distance between the air cushions 40 at the opposite end areas of a chassis 11 (one or more per side) is larger than or the same as the width of the pulper opening in the transverse direction. Preferably, the distance of the air cushions 40 at the end areas of the same side of the chassis 11 (one or more per side) is larger than or the same as the width of the pulper opening in the machine direction.

In accordance with some embodiments, a machine reel cart/winding stand 10 equipped with air cushions 40 may drive across the pulper opening, preferably when the cover of the pulper opening 33 is arranged to be air-tight also at its seams and arranged substantially at floor level. In accordance with some embodiments, a machine reel cart/winding stand may be equipped with wheels (not shown in the figures) for moving on a floor. The wheels may be light-structured so that they, e.g., carry the weight of the machine reel cart/winding stand or the weight of a machine reel cart/winding stand loaded with an empty winding shaft. The wheels may be fitted to the winding stand in addition to air cushion elements.

A movable support apparatus 10 and a movable winding stand enable freer layout of finishing devices (slitters, etc.) than a reel cart technique implemented using storage rails. It is possible to arrange low operating costs for the movable support apparatus 10/movable winding stand, as automatic operation without the presence of the user is possible. Preferably, the arrangement contains a control system or is joined to one which optimizes and administers storage locations and transfers. In accordance with some embodiments, a solution implemented using a movable support apparatus 10/a movable winding stand does not need space in the vertical direction more than approximately the diameter of the machine reel 4, whereby a very low and low-cost building, "a sheet-metal hall", is sufficient for storage. Preferably, safety is secured during the transfer of chassis 11/winding stands utilizing safety solutions used in reel carts and found to be advantageous. As the chassis 11/winding stand is moved at floor level, safety is easier to implement than when using a hoist, for example.

In the description above, air cushion elements 40, 85 have been used as an example of pressure medium cushion elements where air and a gaseous pressure medium have been used as examples of the pressure medium operating the pressure medium cushion element, but another kind of fluid pressure medium also offers a similar performance and effect in the pressure medium cushions of the pressure medium cushion elements. Water is an example of a liquid pressure medium that is suitable for the operating environment in the paper mill. Water, water mixtures, or another fluid or liquid pressure medium can thus be used as a pressure medium for operating the air cushion elements 40, 85. An advantage of using, e.g., water as a pressure medium is that the pressure medium cushion elements can be formed to be small in size, advantageously smaller than the pressure medium cushion elements operating on air/gas.

Compared with the air cushion technique the water cushion technique enables a transfer of heavier masses or an even more energy efficient transfer of equal masses. The carrying capacity of a water cushion is better so that the size of the cushions if necessary may be made smaller which makes easier to place the cushions in the chassis, winding stands and generally the carts of movable support apparatuses.

The function of a water cushion requires a certain overflow in order to form a supporting water film. The water cushions of a machine reel transfer cart, chassis, winding stand applying the water cushion technique can be equipped with one or more suction lath or one or more suction ring which collects water overflow from the cushion onto the floor. A corresponding water recovery technique has been applied with, e.g., floor washing apparatuses wherein wash water or rinsing is collected from the floor. Thus the overflow water of the water cushions does not remain on the floor and the liquid medium may be recycled.

The consumption of water and more generally a liquid pressure medium is much lower than that of air of gas as the load-carrying effect of a liquid cushion element or water cushion element that is like an air cushion element can be achieved at low flows. A small power requirement in pumping of liquid medium enables a battery-powered pumping solution. The amount of water necessary for a transfer movement can be located in the moving part of the support apparatus/winding stand during transfer. Water may be recycled wherein water moves conveniently with the transfer cart. Then a pressure medium supply hose is not necessarily needed, and the movement length of a cart may be longer and freer. Water may be supplied at the targets stations of the transfer or, in the case of long transfers, during transfer as well. A wireless embodiment of the movable support apparatus and the movable winding stand is easier to implement using water-operated pressure medium cushion elements.

The preceding invention and its various applications are suited to be used in connection with various types of paper manufacturing lines, slitter-winder concepts and other process device concepts. The invention may be implemented in connection with both new paper manufacturing lines and complements to and modernizations of existing paper manufacturing lines. The movable support apparatus 10 and the movable winding stand are particularly well suited for rebuilds, where there is usually very limited space available and the conventional layout of storage locations is often not possible. The movable support apparatus 10 and the movable winding stand are suitable for the transport and storage of rolls of a paper machine.

The description given above provides non-limiting examples of some embodiments of the invention. It is apparent to persons skilled in the art that the invention is not confined to the details presented above, but that the invention may also be implemented in other equivalent ways.

Some features of the embodiments presented may be utilized without employing other features. The above description must be regarded as an explanatory account describing the principles of the invention and not as limiting the invention. Thus the scope of the invention is only limited by the appended claims.

The invention claimed is:

1. A method for handling rolls, winding shafts or machine reels for handling of a fiber web, the rolls, winding shafts or machine reels having two supporting ends, the method comprising the steps of:

receiving at least one roll, winding shaft, or machine reel so that the roll, winding shaft, or machine reel is in supporting engagement on its supporting ends between two support members which are arranged on a support chassis;

moving the support chassis in supporting engagement with the received roll, winding shaft, or machine reel over a floor between at least two target stations so that the support chassis moves between at least two devices of a fiber web manufacturing process;

wherein the step of moving the support chassis further comprises:

supplying pressurized air to at least four annular bellows, each annular bellows being mounted air-tightly to and below a frame which is mounted to and below the support chassis such that each bellows expands toward the floor, each bellows having a lower edge opposite the floor, the lower edge defining a film;

supplying pressurized air to a space between the film, the frame, the bellows and the floor to form a film of air between the film and the floor which supports the frame and the chassis on which the frame is mounted; and moving the chassis between the at least two devices of a fiber web manufacturing process supported on the film of air.

2. The method of claim 1 wherein the method further comprises moving rolls, winding shafts and machine reels between a winder and a process apparatus next in process order.

3. The method of claim 1 wherein the method further comprises positioning the support chassis in a winding station for winding or unwinding.

4. The method of claim 3 wherein the method further comprises deviating in the lateral direction a machine reel held up by the support chassis positioned in the winding station.

5. The method of claim 3 wherein the method further comprises moving in a machine direction a machine reel held up by the support chassis positioned in the winding station.

* * * * *